US007125182B2

(12) United States Patent
Campbell et al.

(10) Patent No.: US 7,125,182 B2
(45) Date of Patent: Oct. 24, 2006

(54) PRINTER

(75) Inventors: Donald A. Campbell, Johnson City, NY (US); Donald J. Ward, Sayre, PA (US)

(73) Assignee: Paxar Americas, Inc., Miamisburg, OH (US)

( * ) Notice: Subject to any disclaimer, the term of this patent is extended or adjusted under 35 U.S.C. 154(b) by 41 days.

(21) Appl. No.: 10/779,990

(22) Filed: Feb. 17, 2004

(65) Prior Publication Data

US 2005/0180796 A1 Aug. 18, 2005

(51) Int. Cl.
*B56H 75/24* (2006.01)

(52) U.S. Cl. ..... 400/613; 400/611; 400/407.1; 242/578.1; 242/578.2; 242/586.4

(58) Field of Classification Search ..... 400/611, 400/613, 613.1; 101/407.1; 242/578.1, 242/578.2, 586.1, 586.4, 596.7
See application file for complete search history.

(56) References Cited

U.S. PATENT DOCUMENTS

| | | | | |
|---|---|---|---|---|
| 362,731 | A | 5/1887 | Ellis | |
| 3,565,360 | A * | 2/1971 | Ura | 242/575 |
| 3,596,846 | A | 8/1971 | Johnston | |
| 3,799,465 | A | 3/1974 | Emy | |
| 3,944,153 | A | 3/1976 | Linker | |
| 4,278,112 | A * | 7/1981 | Takahashi | 139/452 |
| 4,418,618 | A | 12/1983 | Huggins | |
| 4,813,626 | A * | 3/1989 | Sakumoto | 242/245 |
| 4,991,785 | A | 2/1991 | Kuo et al. | |
| 5,241,407 | A | 8/1993 | Sonehara et al. | |
| 5,486,259 | A | 1/1996 | Goodwin | |
| 5,645,247 | A | 7/1997 | Voigt | |
| 5,695,291 | A | 12/1997 | Park | |
| 5,785,442 | A | 7/1998 | Hamisch, Jr. | |
| 5,820,277 | A | 10/1998 | Schulte | |
| 5,833,377 | A | 11/1998 | Keller | |
| 5,961,228 | A | 10/1999 | Ward | |
| 6,059,468 | A | 5/2000 | Haug | |
| 6,078,345 | A | 6/2000 | Yamakawa | |
| 6,142,622 | A | 11/2000 | Blanchard | |

(Continued)

FOREIGN PATENT DOCUMENTS

DE 32 29 036 A1 5/1984

(Continued)

OTHER PUBLICATIONS

Users Manual, Paxar Model 656/636 Manual Edition 6.3, Aug. 8, 2003 with notes on p. 82B.
Ink Jet Care Label Printers from Markem Technology That Delivers High-Quality Care Labels at Savings of up to 50% brochure, circa 1999.

*Primary Examiner*—Daniel J. Colilla
*Assistant Examiner*—Kevin D. Williams
(74) *Attorney, Agent, or Firm*—Joseph J. Grass

(57) ABSTRACT

Disclosed are a printer and a stacker and methods. The printer prints selectively on one or both sides of a printable web and sheets or labels are cut from the web and stacked in the stacker. The printer has an unwind mechanism that accepts and holds web rolls of different widths in center-justified relationship with respect to a print head. The printer has a spindle for mounting an ink ribbon core with a detent for center-justifying the ink-ribbon with respect to the print head.

53 Claims, 31 Drawing Sheets

U.S. PATENT DOCUMENTS

| | | | | |
|---|---|---|---|---|
| 6,155,517 | A | 12/2000 | Lippold et al. | |
| 6,164,203 | A * | 12/2000 | Keller | 101/407.1 |
| 6,241,407 | B1 | 6/2001 | Huggins | |
| 6,336,760 | B1 | 1/2002 | Mori | |
| 6,338,452 | B1 * | 1/2002 | Vogel | 242/571 |
| 6,345,781 | B1 * | 2/2002 | Bowers | 242/422.4 |

FOREIGN PATENT DOCUMENTS

| | | |
|---|---|---|
| DE | 37 23 592 A1 | 1/1989 |
| GB | 1003920 | 9/1965 |
| JP | 62 074858 | 4/1987 |
| JP | 62 167919 | 7/1987 |

* cited by examiner

PRINTER

FIELD OF THE INVENTION

This invention relates to the field of printers and stackers and to methods of printing and stacking labels.

BACKGROUND OF THE INVENTION

The following prior art is made of record: U.S. Pat. Nos. 4,418,618; 5,486,259; 5,695,291; 5,785,442; 5,820,277; 5,833,377; 5,961,228; 6,059,468; 6,078,345; 6,142,622; 6,164,203; 6,241,407; 6,336,760; Users Manual, Paxar Model 656/636 Manual Edition 6.3, 8 Aug. 2003; and Ink Jet Care Label Printers From Markem Technology That Delivers High-Quality Care Labels At Savings Of Up to 50% brochure, circa 1999.

SUMMARY OF THE INVENTION

The invention relates to an improved, low cost, apparatus that can print on both sides of a web, cut the web into predetermined length labels and accumulate the labels in a stack.

It is a feature of the invention to provide an improved printer with a stacker wherein the printer and the stacker each have a small footprint, and wherein the printer and/or the stacker are light enough in weight to be portable.

It is a feature of the invention to provide an improved printer having a first print head and an idler platen roll cooperable with the first print head to print on one side of a web, and a second print head and a driven platen roll cooperable with the second print head and disposed downstream of the first platen roll to print on the other side of the web. This obviates the problems of a prior art printer in which both platen rolls were driven.

It is another feature of the invention to provide an improved printer having at least one print head and a cooperable platen roll, wherein the platen roll is cantilevered and is movable into and out of printing cooperation with the print head. This facilitates threading of the web through the printer. The print head is latched or locked in position after the web has been threaded through the printer.

It is another feature of the invention to provide an improved printer having a first print head and a cooperable cantilever-mounted idler first platen roll, and a second print head and a cooperable cantilever-mounted driven second platen roll, wherein the platen rolls are movable toward and away from their respective print heads to facilitate threading of a printable supply web through the printer.

It is another feature of the invention to provide a print head and idler platen roll, wherein the idler roll is movable toward and away from the print head to facilitate threading of the supply web through the printer, wherein the platen roll is held in a rest position away from the print head, unless the platen roll is moved into cooperation with the print head where the platen roll is releasably latched in position with respect to the print head.

It is another feature of the invention to provide an improved printer wherein the platen roll is movable into and out of printing cooperation with the print head, wherein the platen roll causes a latch member to be cammed to a position to receive and latch the platen roll in printing cooperation with the print head.

It is another feature of the invention to provide an improved printer wherein a stationary print head cooperates with a platen roll which is movable into and out of printing cooperation with the print head, wherein the platen roll is cantilevered to facilitate threading of the printer, and a latch latches the platen roll in printing cooperation with the print head.

It is another feature of the invention to provide an improved printer for printing on a web, using a driven platen roll cooperable with a print head, wherein the web is fed to a cutter by an auxiliary feed roll, and a stacker feed roll feeds the cut labels into a stacker, and wherein the platen roll, the auxiliary feed roll and the stacker feed roll are driven by a single electric motor.

It is another feature of the invention to provide an improved printer with a generally vertical frame plate, and a stacker with a rear wall inclined upwardly and rearwardly, a side wall inclined downwardly and outwardly away from the printer, and a platform mounted adjacent the side and rear walls and movable to lower positions as labels accumulate on the platform.

It is another feature of the invention to provide an improved stacker and stacking method, wherein a feed roll feeds labels one-by-one in a forward direction past a wall, and wherein the feed roll is positioned to contact the upper side of the trailing marginal edge of the label to feed the label in the retrograde direction until the trailing edge of the label contacts the wall.

It is another feature of the invention to provide an improved stacker having a platform and a feed roll to feed labels onto the top of the stack, an electric motor, and a belt coupled to the motor and the platform to lower the platform as the amount of the labels in the stack increases.

It is another feature of the invention to provide an improved printer having an electric motor having a first shaft, a first gear on the first shaft, an arm with a pivot axis, a second gear mounted along the pivot axis and meshing with the first gear, a third gear mounted on the arm and meshing with the second gear, a rotatable platen roll secured to the third gear, a print head, the platen roll being cooperable with the print head to print on a web, rotation of the arm being effective to move the platen roll user-selectively between a non-printing position out of cooperation with the print head and a printing position in printing cooperation with the print head.

It is another feature of the invention to provide a holder for a supply roll wherein a clamp has at least one clamp member extendable and movable into clamping relationship to a side of a supply roll and wherein the clamp member is retractable to enable a supply roll to be loaded onto or removed from the hub, wherein there is a means for extending the clamp member and for moving the clamp member into clamping relationship with the side of the supply roll.

It is another feature of the invention to provide a printer with a center-justifying holder for a web, the holder having a hub for locating the web roll, a clamp movable between a retracted position to enable a supply roll to be mounted on the hub and an extended position in which the clamp is disposed at a side of the supply roll, a manually rotatable shaft, the hub and the clamp being coupled to the shaft to enable the clamp in its extended position to move in unison with the hub to bring the supply roll into alignment with the print head and to clamp the supply roll onto the hub upon rotation of the shaft.

It is another feature of the invention to provide an improved holder for a supply roll, wherein a hub locates a supply roll, a clamp having at least one clamp member is movable between a retracted position to enable a supply roll to be mounted on or removed from the hub and an extended position in which the clamp member is disposed at a side of the supply roll, a manually rotatable shaft, and the clamp member being coupled to the shaft and to the hub to enable the clamp member in its extended position to move into clamping relationship to the side of the supply roll upon rotation of the shaft.

It is another feature of the invention to provide an improved method of holding a supply roll including mounting a supply roll on a hub, providing at least one clamp member, moving the clamp member from a retracted position to an extended position along a side of the supply roll, and moving the clamp member and the hub toward each other in unison to clamp the supply roll to the hub.

It is another feature of the invention to provide an improved spindle assembly wherein a spindle can mount supply roll cores of different widths having respective web of different widths wound thereon, and wherein a movable detent or latch on the spindle justifies the mounted core and is releasable to enable the core to be removed from the spindle.

It is a feature of the invention to provide an improved spindle including a movable latch having at least one pair of connected stepped shoulders engageable with opposed ends of a supply roll of a predetermined width, and the mounted supply roll core being center-justified by and between the engaged pair of shoulders of the latch.

BRIEF DESCRIPTION OF THE DIAGRAMMATIC DRAWINGS

DETAILED DESCRIPTION OF THE PREFERRED EMBODIMENTS

Figure 1:
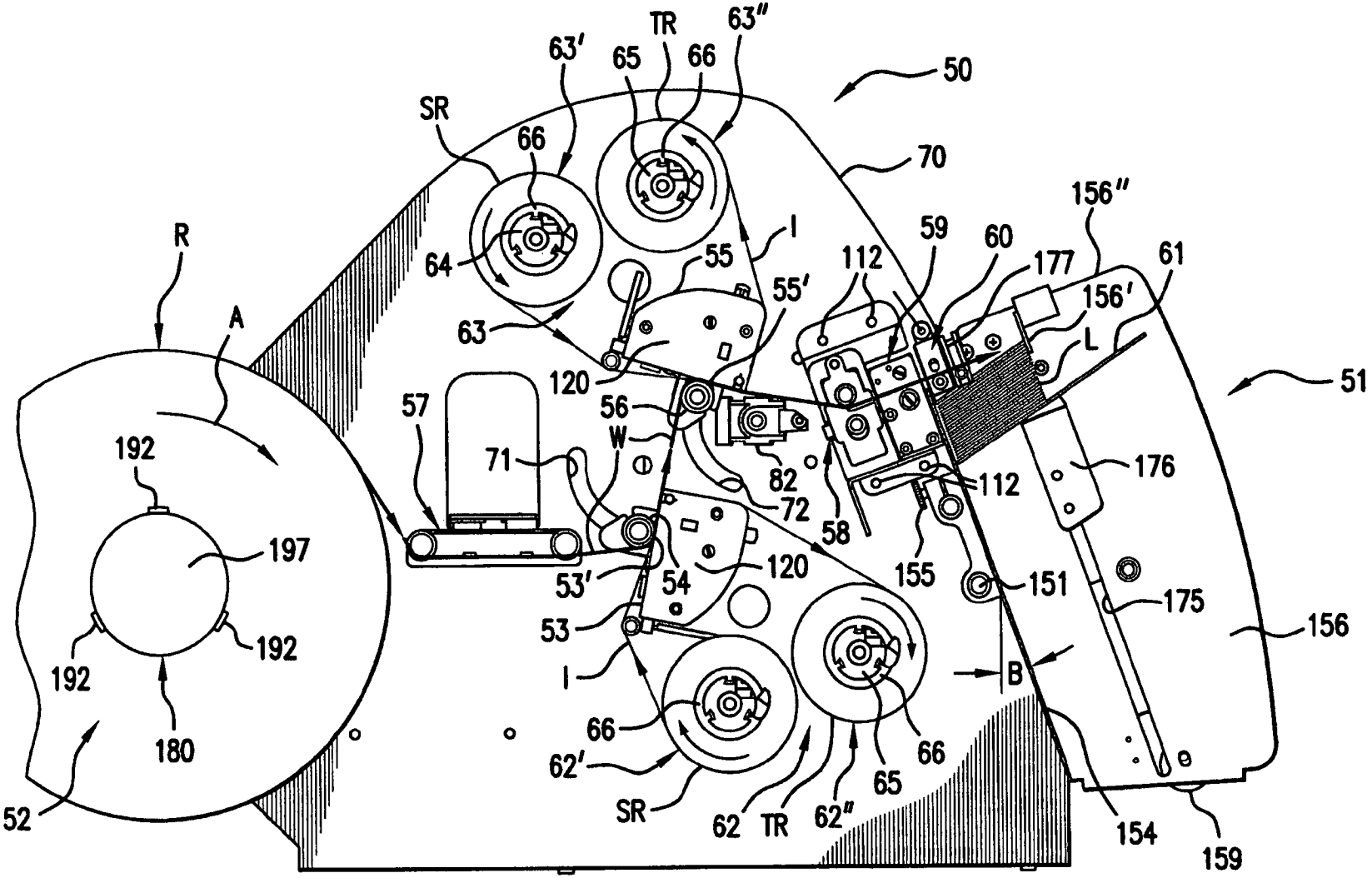
FIG. 1 is a front elevational view of a printer in accordance with an embodiment of the invention showing a printable web threaded to be printed on both sides.

With reference initially to FIG. 1, there is shown a printer generally indicated at 50 for printing on a printable web W and a stacker generally indicated at 51. The web W is initially in the form of a wound supply roll R mounted on an unwind mechanism generally indicated at 52. The web W is drawn through the printer 50 in the direction of arrows shown along the path of the web W. As the web W is paid out of the web roll R, the web roll R rotates clockwise in the direction of arrow A. The unwind mechanism 52 applies a slight tensioning force to the web W by attempting to rotate the roll R counterclockwise, that is, in a direction opposite to the direction of the arrow A. However, the force exerted on the web W to feed the web W through the printer 50 overcomes the force exerted by the unwind mechanism to enable the web W to be fed through the printer 50. By this arrangement the web W is always maintained under the desired tension.

The printer 50 includes a print head assembly 53 and a cooperable platen in the form of a platen roll 54. The printer 50 also includes another print head assembly 55 and a cooperable platen in the form of a platen roll 56. The print head assembly 53 and the platen roll 54 may be termed the "first" print head assembly and the "first" platen roll, respectively, because they are upstream of the print head assembly 55 and the platen roll 56. Similarly, the print head assembly 55 and the platen roll 56 are downstream of the print head assembly 53 and the platen roll 54 and may be termed the "second" print head assembly and the "second" platen roll. The print head assemblies 53 and 55 are identical and the platen rolls 54 and 56 are identical. The print head assemblies 53 and 55 are secured to the frame plate 70 by screws (not shown).

A thermal print head 53' at a side of the print head assembly 53 cooperates with the platen roll 54 to print on the underside of the web W. A thermal print head 55' at a lower side of the print head assembly 55 cooperates with the platen roll 56 to print on the upper surface of the web W. The platen rolls 54 and 56 are shown in their respective latched positions in FIG. 1.

The platen roll 54 is a non-driven or idler roll, but the platen roll 56 is a driven roll. During operation of the printer 50, the platen roll 56 feeds the web W from the roll R past a guide mechanism generally indicated at 57 to between the print head 53' and the platen roll 54 and to between the print head 55' and the platen roll 56. From there the web W passes to an auxiliary feed mechanism generally indicated at 58 which feeds the web W to a cutter or cutter mechanism 59. The cutter 59 cuts the web W into predetermined length sheets, in particular labels or tags L. The labels or tags L are fed by a stacker feed mechanism generally indicated at 60 onto a platform 61 of the stacker 51.

It is preferred that the printer 50 be of the thermal transfer type, wherein ink ribbons I pass between the thermal print heads 53' and 55' and the web W. A first ink ribbon system 62 is associated with the first print head assembly 53 and the platen roll 54, and a second ink ribbon system 63 in associated with the print head assembly 55 and the platen roll 56. The ink ribbon systems 62 and 63 are identical. The systems 62 and 63 each have a supply spindle 64 and a take-up spindle 65 of identical construction. Each spindle 64 mounts a supply roll SR and each spindle 65 mounts a take-up roll TR. Each roll SR and TR is mounted on a core 66, and each spindle 64 and 65 is driven by a mechanism best shown in FIG. 24. Each system 62 and 63 is microprocessor controlled.

Figure 2:
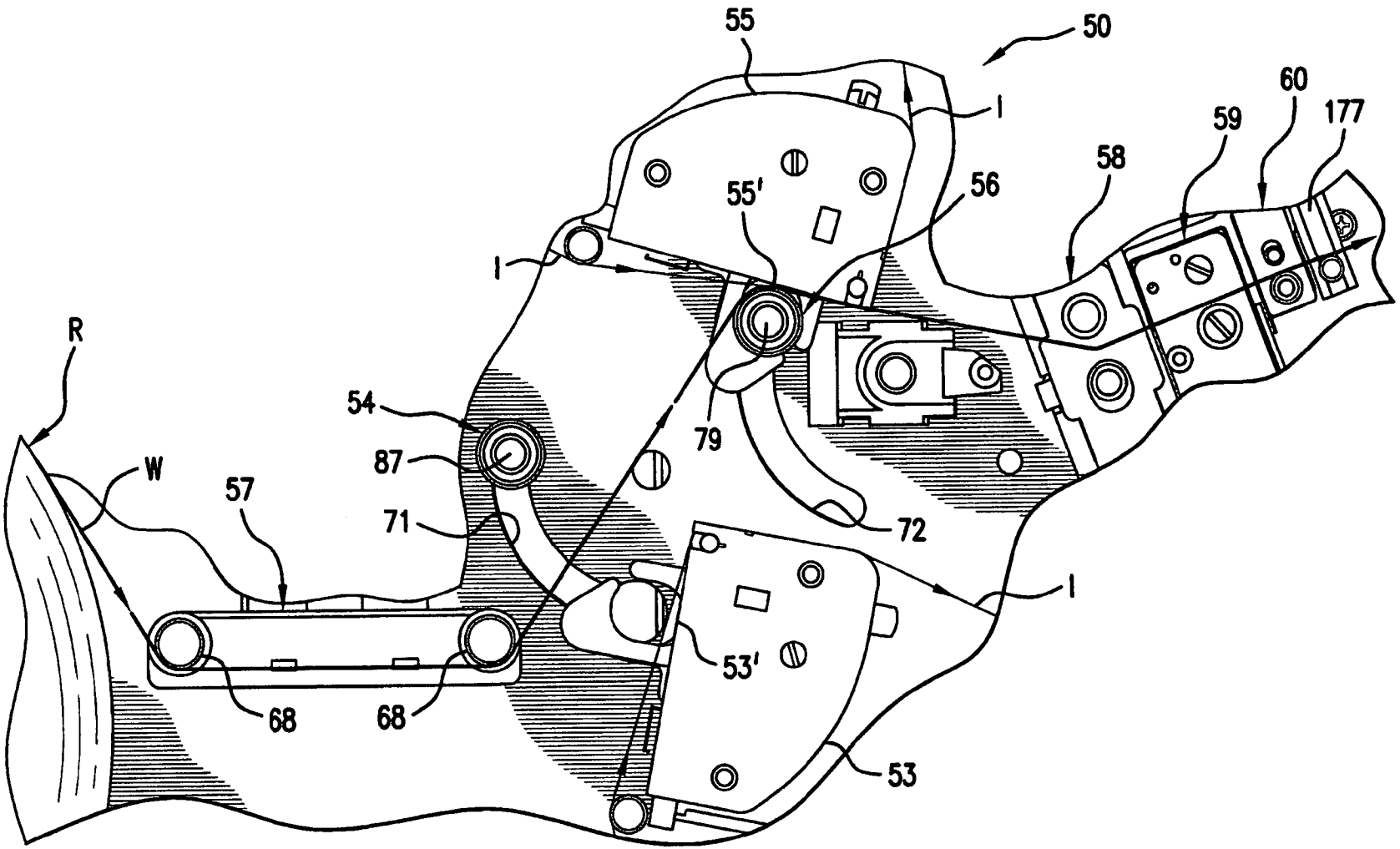
FIG. 2 is a fragmentary front elevational view showing the printer in an arrangement in which only one side of the web is being printed.

As shown in FIG. 2, the printer 50 is also constructed to enable printing on only one side of the web W, if desired. As shown in FIG. 2, the platen roll 54 has been moved completely out of the path of the web W to a rest or inoperative position. The web W is also spaced from the print head 53'.

Figure 3:
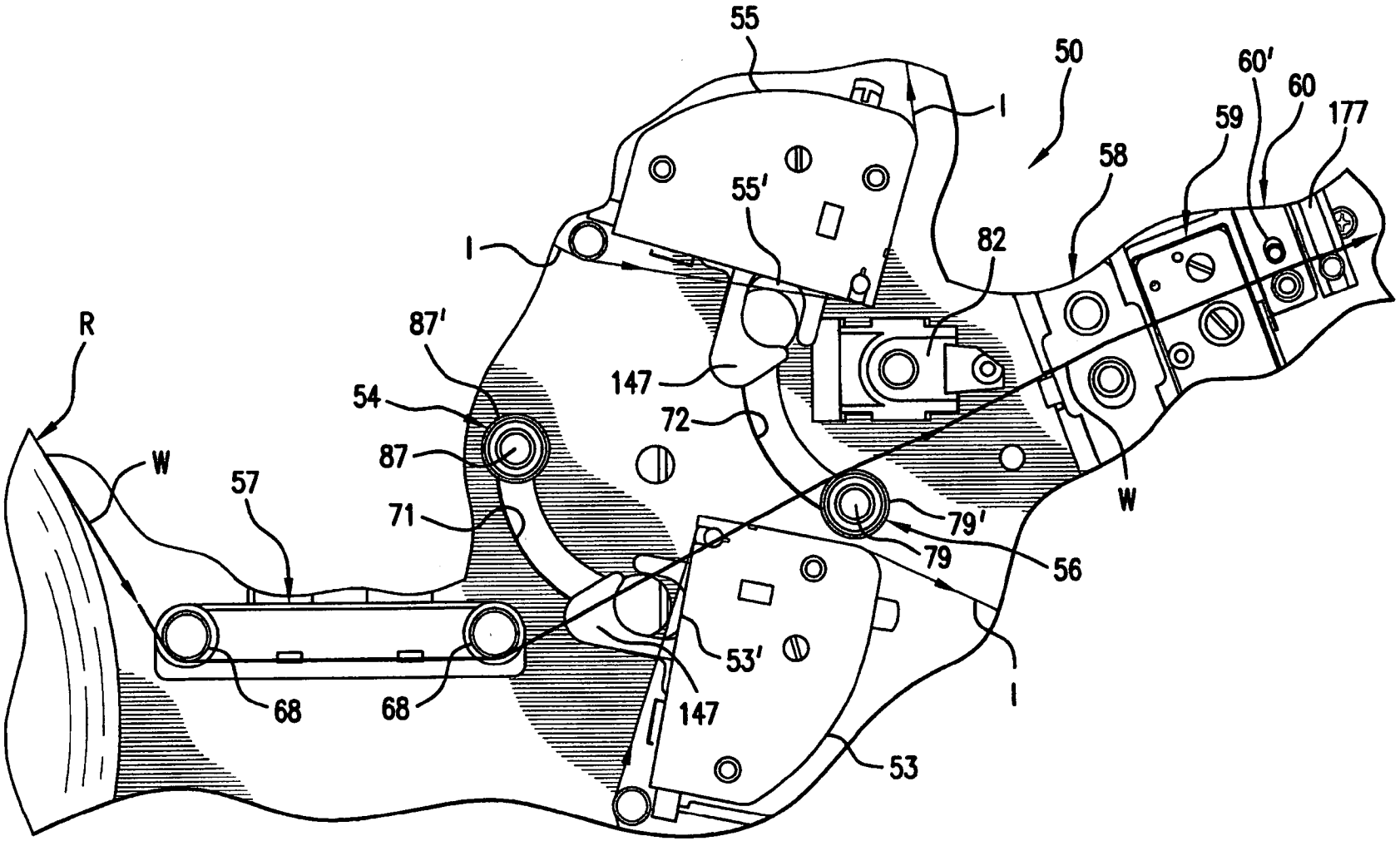
FIG. 3 is a fragmentary front elevational view showing the printer in an arrangement in which the web is being threaded through the printer prior to printing.

FIG. 3 shows the printer 50 in its threading position in which the web W can be easily threaded from the supply roll R directly to the auxiliary feed mechanism 58. As shown in FIG. 3, both platen rolls 54 and 56 have been moved to their rest or inoperative unlatched positions spaced from their respective print heads 53' and 55'. Because the platen rolls 54 and 56 are cantilevered and are separable from their respective print head assemblies 53 and 55, the web W and ink ribbons I can be readily threaded through their respective paths because the front of the printer is readily user-accessible.

Figure 4:
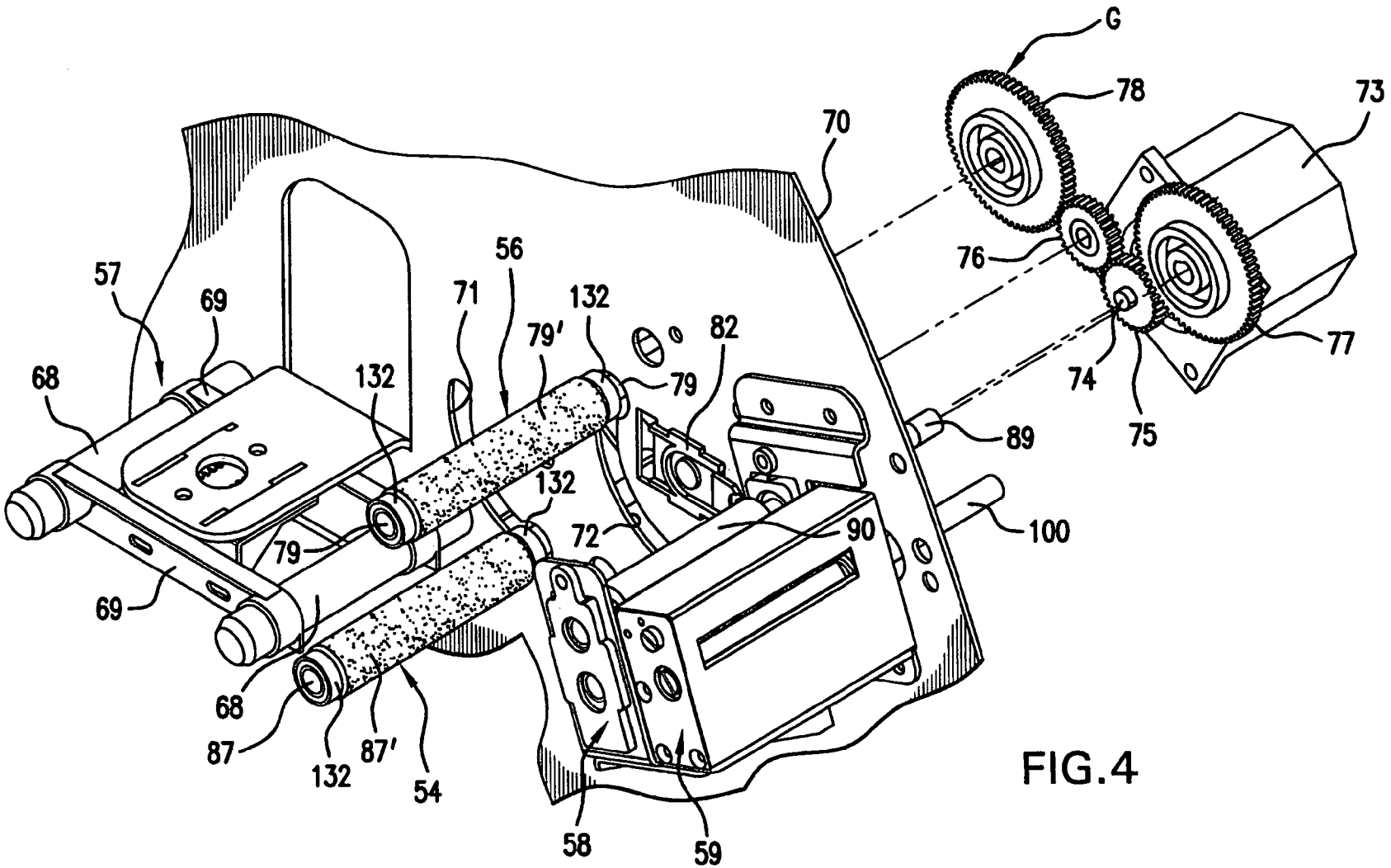
FIG. 4 is a fragmentary perspective view showing two platen rolls, the auxiliary feed mechanism and the cutter, wherein the one platen roll and the auxiliary feed mechanism are driven from a single electric motor through gearing.

With reference to FIG. 4, the guide mechanism 57 is shown to include a pair of spaced guides 68. The guides 68 can guide the web W from the supply roll R to any one of the positions shown in FIGS. 1 through 3. Side guides 69 guide the side edges of the web W. The side guides 69 are center-justified by a type of mechanism having a pinion meshing directly with two racks as in above-mentioned U.S. Pat. No. 5,820,277.

FIG. 4 shows that the auxiliary feed mechanism 58 and the cutter 59 are secured to a vertically extending frame plate 70. The frame plate 70 are arcuate slots or cutouts 71 and 72 which enable the platen rolls 54 and 56 to be swung between the rest or inoperative position and the operating position. In FIG. 4, the platen rolls 54 and 56 are shown in their operative positions, it being noted that the print head assemblies 53 and 55 have been omitted for the sake of clarity. An electric motor 73 has an output shaft 74 to which a gear 75 is secured. The gear 75 meshes directly with gears 76 and 77, and the gear 76 meshes directly with a gear 78. The gear 78 is secured to a shaft 79 of the platen roll 56. The gear 77 drives the auxiliary feed mechanism 58. The gears 75 through 78 are referred to generally as gearing G.

Figure 5:
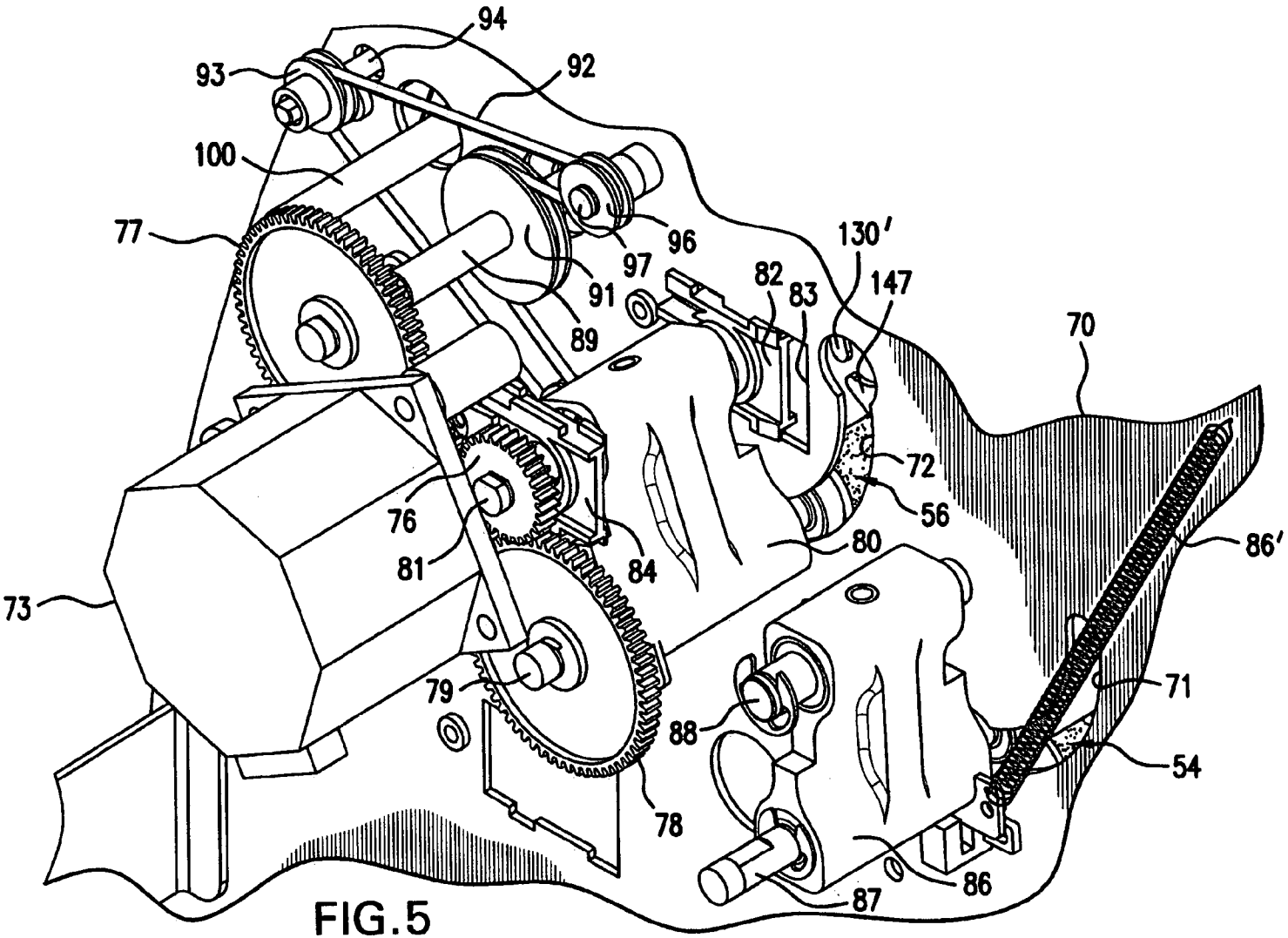
FIG. 5 is a fragmentary perspective view of the rear portion of the printer showing the arrangement for mounting the platen rolls, a belt and gearing.
Figure 7:
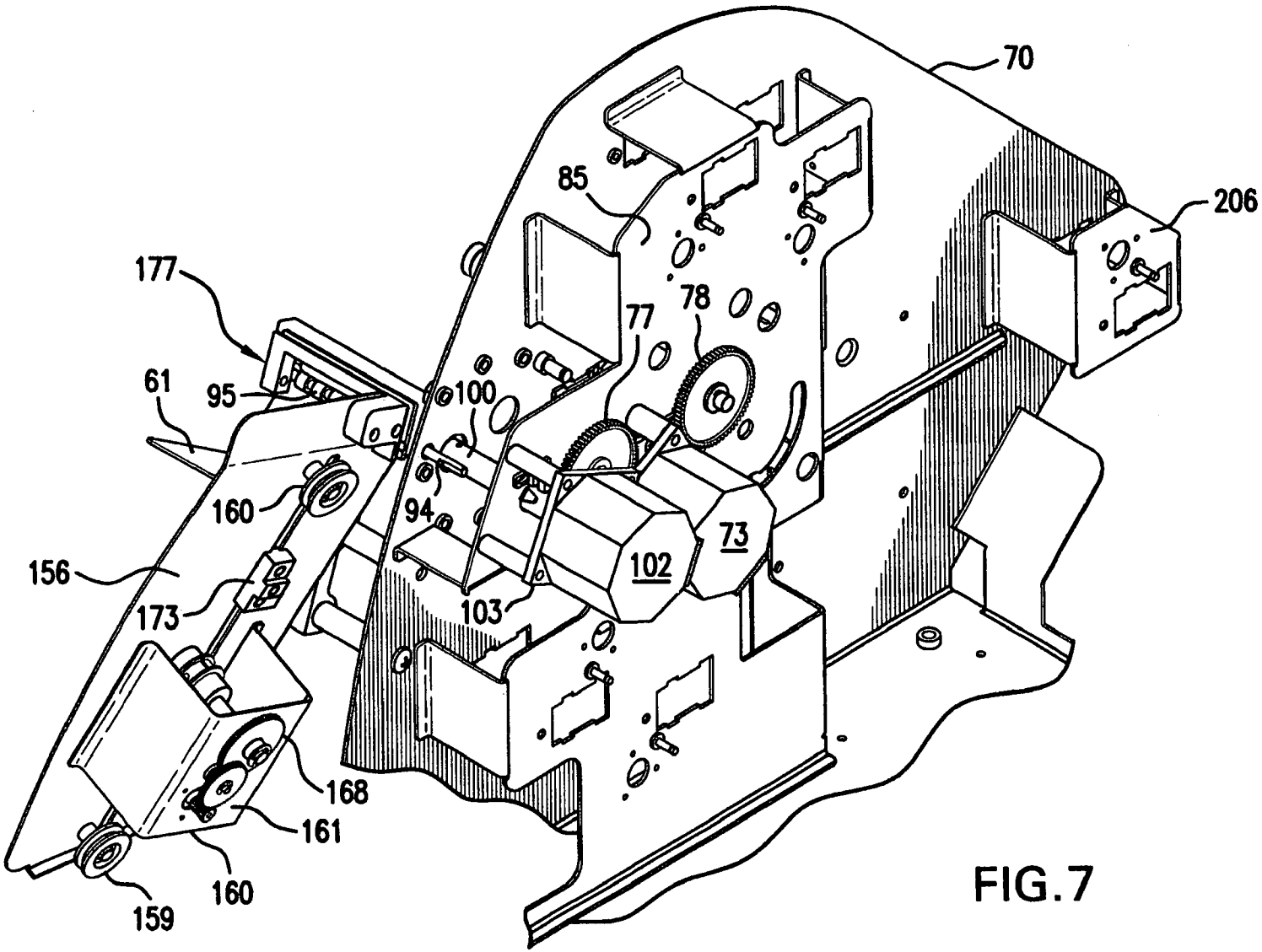
FIG. 7 is a fragmentary perspective view of the rear portion of the printer and a portion of the stacker.

With reference to FIG. 5, the frame plate 70 is shown to mount an arm 80. The arm 80 is mounted for pivotal movement on a shaft 81. The shaft 81 is mounted in a bearing 82 mounted in a cutout 83 in the frame plate 70 and in a bearing 84 mounted in a standoff 85 (FIG. 7). The arm 80 rotatably mounts the shaft 79 which is spaced from the axis of the pivot 81. The platen roll 56 is cantilevered to the arm 80. The gear 78 is secured to the shaft 79 so that the platen roll 56, the shaft 79 and the gear 78 rotate as a unit when the motor 73 is operated. It is apparent that movement of the arm 80 and the platen roll 56 between operative and inoperative positions does not affect the drive connections between the gears 75, 76 and 78. The gear 76 is on the axis of the shaft 81. The gear 76 is an idler gear that drives the driven gear 78.

Resilient, elastomeric, frictional sleeves 79' and 87' are received about respective shafts 79 and 87. The sleeves 79' and 87' are preferably molded directly onto the shafts 79 and 87. An arm 86 identical to the arm 80 rotatably receives a platen roll shaft 87 of the platen 54. The platen rolls 54 and 56 and their respective shafts 87 and 79 are identical. The arm 86 is pivotally mounted to a shaft 88 cantilevered to the frame plate 70. The platen roll 54 is cantilevered to the arm 86. The platen roll 54 is shown in the printing position, while the platen roll 56 is shown in its inoperative or non-printing position in FIG. 5. A tension spring 86' connected to the arm 86 and to the frame plate 70 normally urges and holds the platen roll 54 in its inoperative position, however, the spring 86' is extended when the platen roll 54 is in its operative position wherein the platen roll 54 is latched in position by the print head assembly 53.

Figure 6:
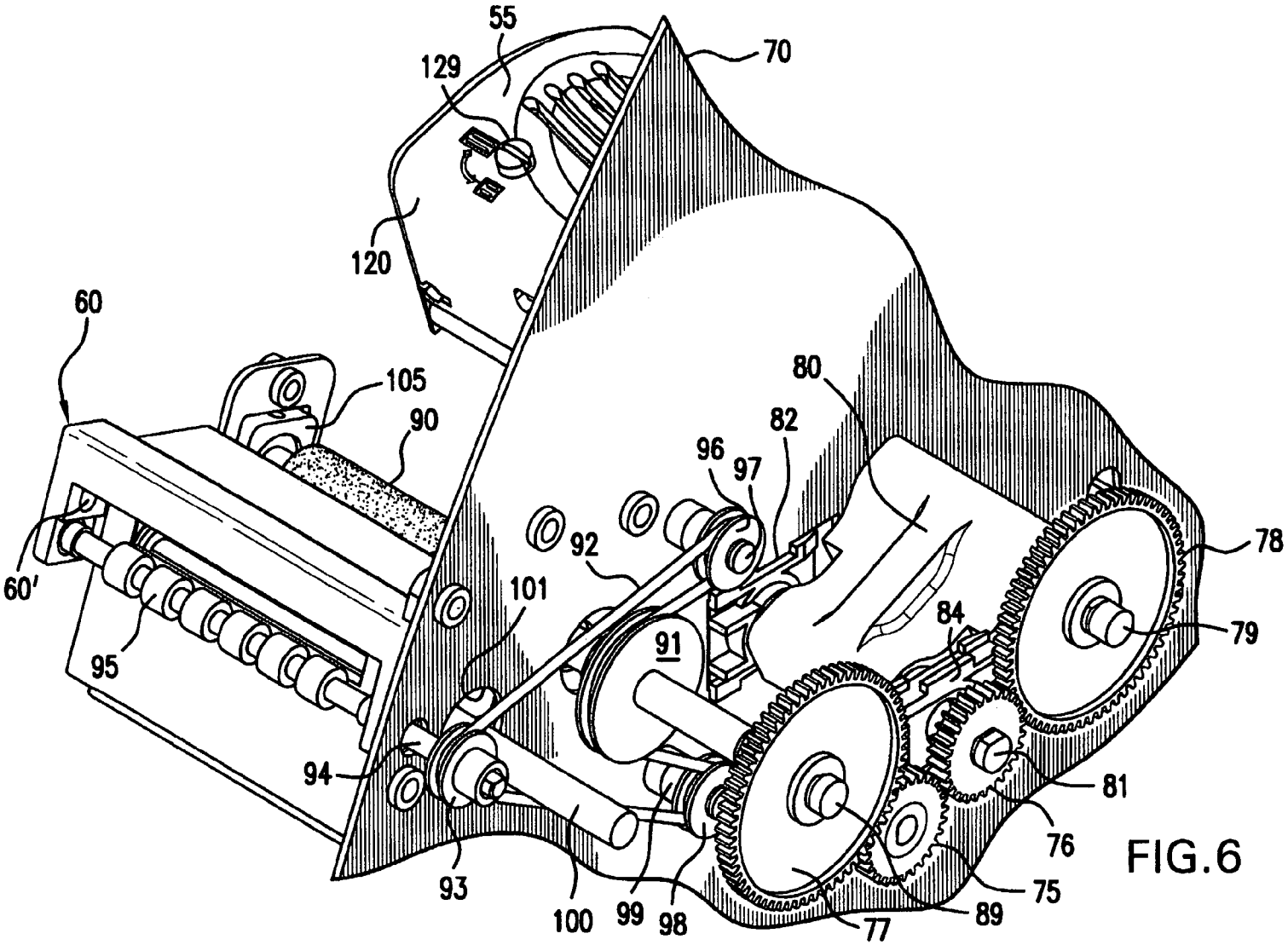
FIG. 6 is a fragmentary perspective view of certain components also shown in FIG. 5 and the stacker feed mechanism.
Figure 8:
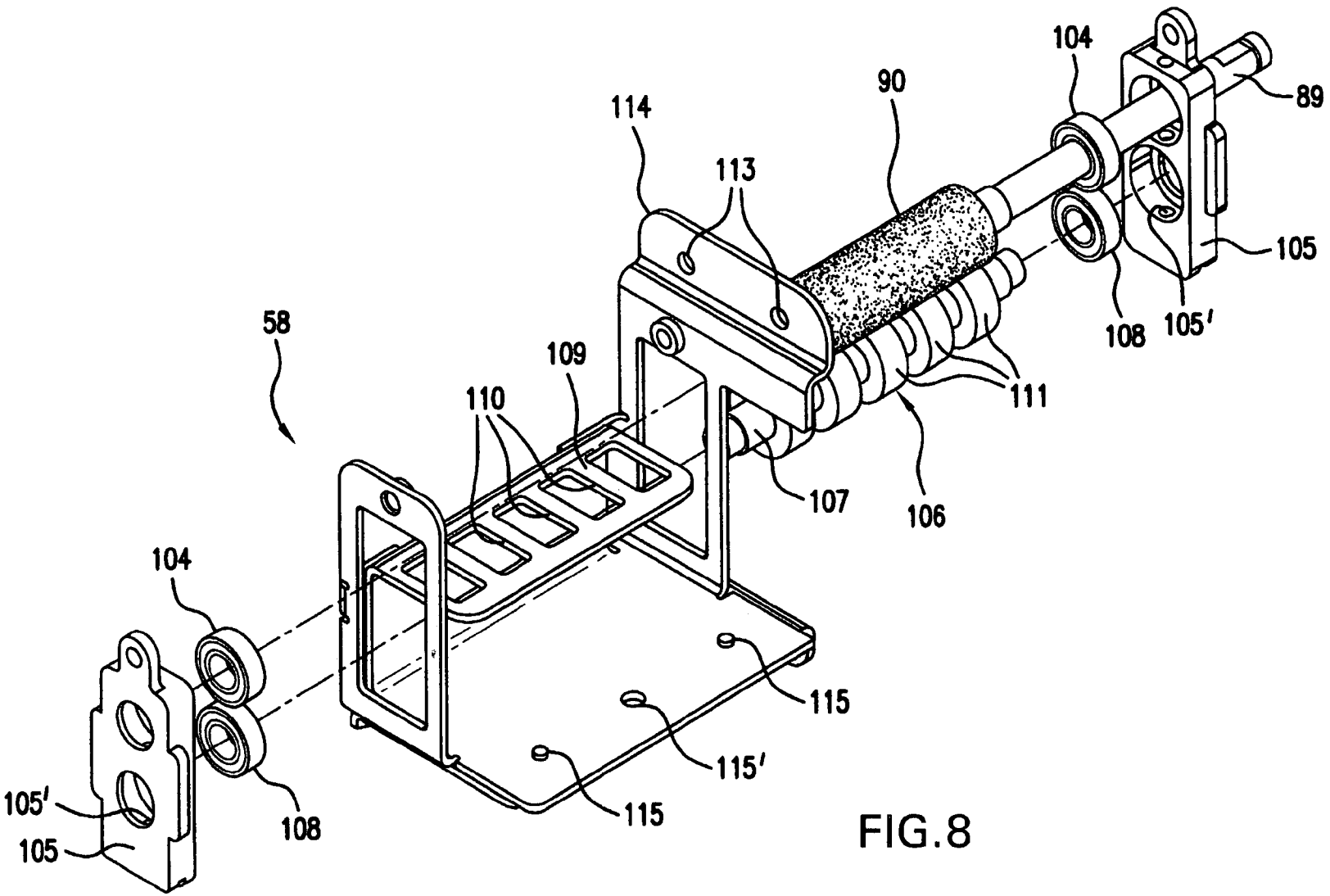
FIG. 8 is an exploded perspective view of the auxiliary feed mechanism.

In that the gear 77 is driven by the electric motor 73 through the gear 75, the gear 77 drives a shaft 89 of a frictional feed roll 90 (FIG. 8). The gear 77 and a pulley wheel 91 are secured against rotation relative to the shaft 89. An endless belt 92 drives a pulley wheel 93 and stacker feed roll shaft 94. The shaft 94 drives a frictional stacker feed roll 95 (FIG. 6). The belt 92 also passes partly around an idler pulley wheel 96 rotatable on a shaft 97 (FIGS. 5 and 6) and about another idler pulley wheel 98 (FIG. 6) rotatable about a shaft 99 cantilevered to the frame plate 70. A cutter shaft 100 extends through an enlarged hole 101 in the frame plate 70. As best shown in FIG. 7, the cutter shaft 100 is driven directly by a stepping motor 102. The stepping motors 73 and 102 are mounted to a standoff 103 which is in turn mounted to the standoff 85.

With reference to FIG. 8, the feed wheel shaft 89 is rotatably mounted in spaced bearings 104 mounted in identical bearing blocks 105. The feed roll 90 cooperates with a backing roll 106 having a shaft 107 rotatably mounted in spaced bearings 108 loosely mounted in turn in the bearing blocks 105. The bearing blocks 105 have recesses 105' which receive respective compression springs (not shown) which urge the bearings 108 upwardly so that the roll 106 is urged into feeding contact with feed roll 90. The web W passes between the rolls 90 and 106 and over a shelf or platform 109. The platform 109 has slots 110 onto which roll portions 111 of the roll 106 extend. Thus, the nip between the rolls 90 and 106 is at the level of or slightly above the upper surface of the platform 109. The auxiliary feed roll assembly 58 is secured to the frame plate 70 by screws 112 (FIG. 1) passing through holes 113 in the subframe plate 114.

Figure 9:
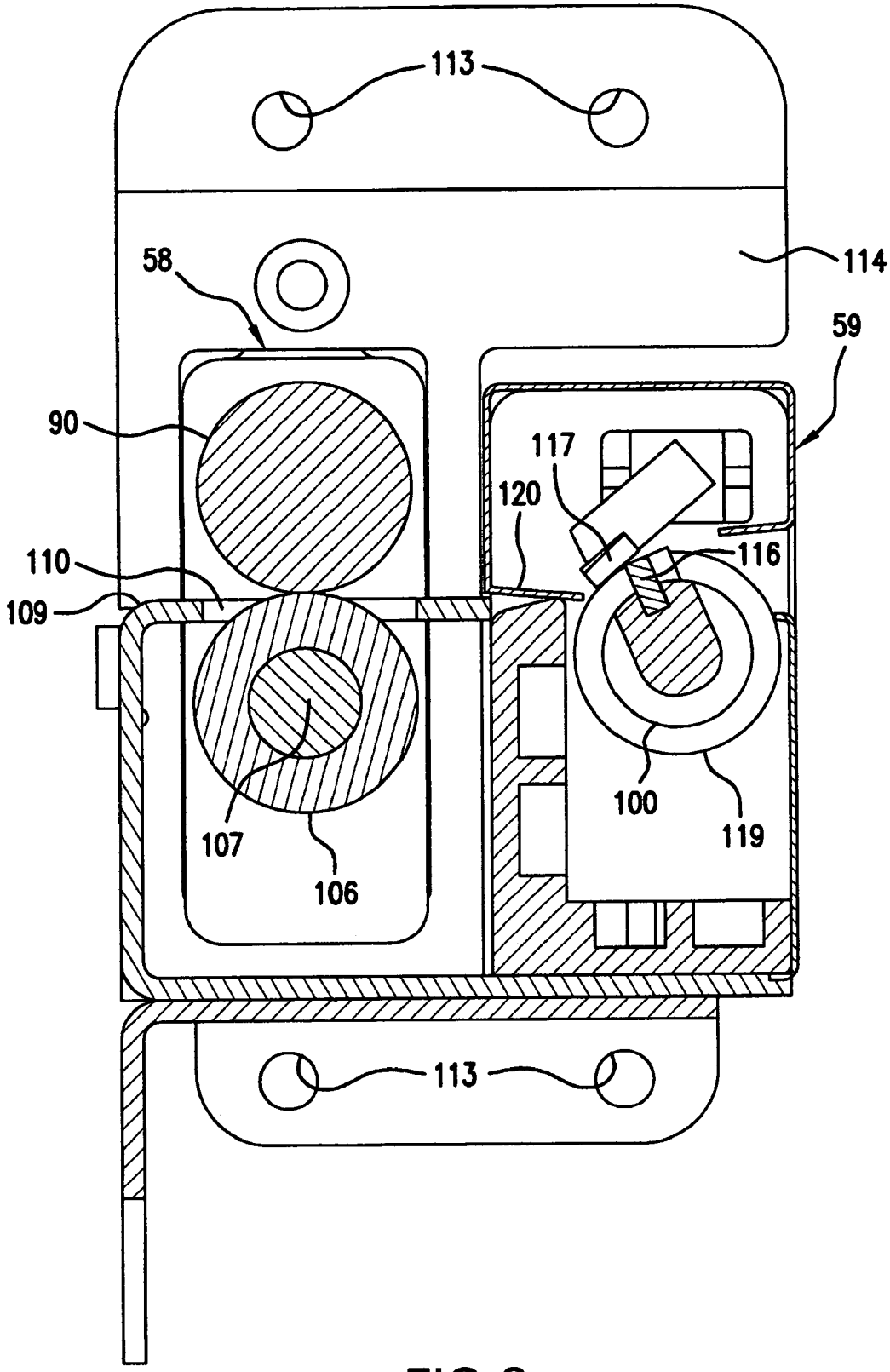
FIG. 9 is an enlarged sectional view of the auxiliary feed mechanism and a cutter.

The cutter assembly or cutter 59 is located by locators 115 (FIG. 8) and fastened to the plate 114 by a screw (not shown) passing through a hole 115' in the plate 114. The knife assembly 59 includes a knife 116 (FIG. 9) mounted on the shaft 100 and a cooperable pivotally mounted knife 117. The knife 117 is spring-biased against a cam 119. The knife 116 and its shaft 100 make a single complete revolution when the stepping motor 102 is energized to cut a label L from the web W. In so doing the shaft 100 and the knife 116 start in the nine o'clock position as seen in FIG. 9 and rotate clockwise until the knife 116 cooperates with the knife 117 to cut a label L from the web W. A guide 120 extends just short of the nip of the knives 116 and 117 to confine the path of movement of the web W into the nip of the knives 116 and 117.

Figure 10:
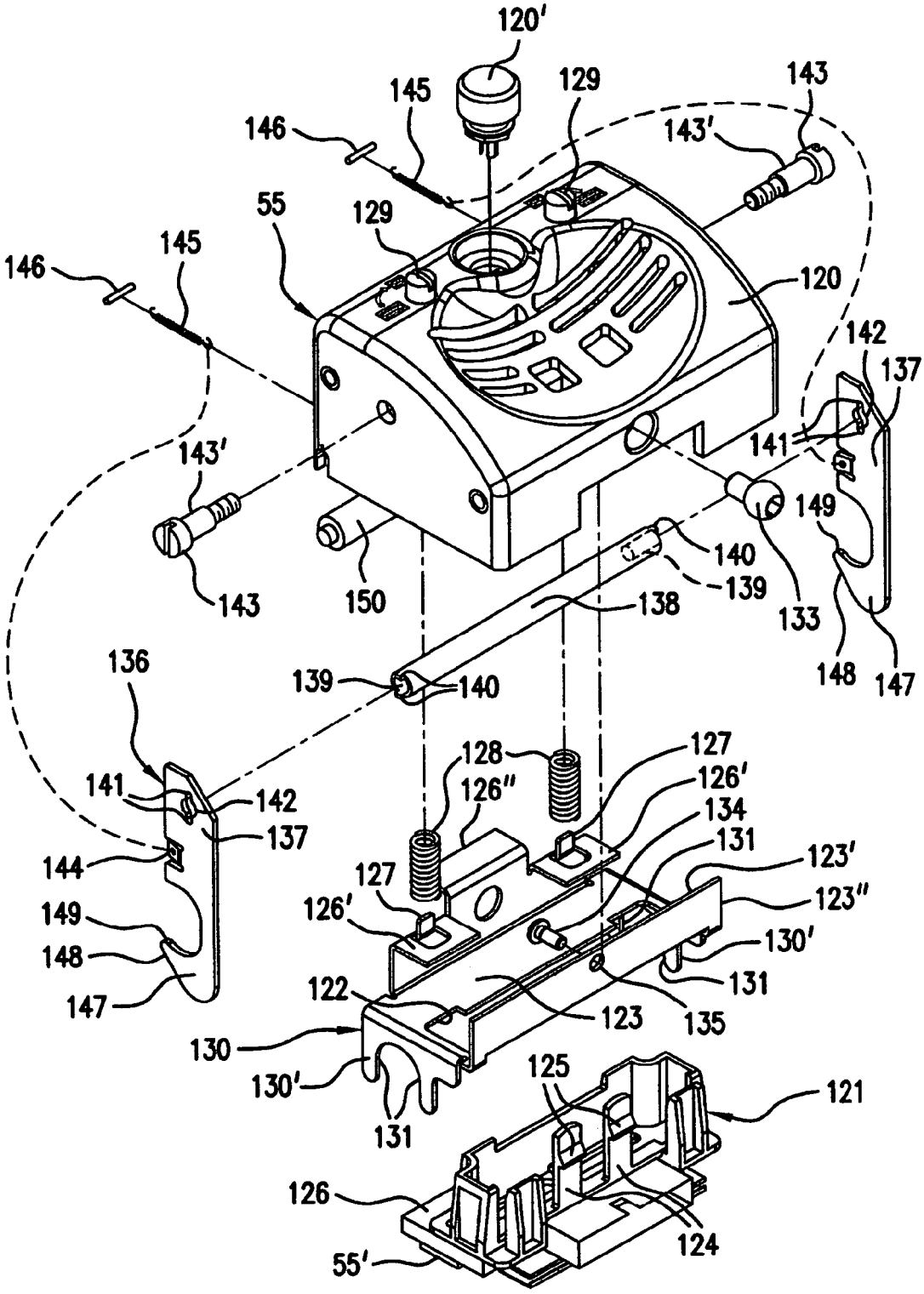
FIG. 10 is an exploded perspective view of a print head assembly.

With reference to FIG. 10, one of the two identical print head assemblies, for example the print head assembly 55, is illustrated in exploded form. The print head assembly 55, as the print head assembly 53, has a frame or housing 120 which is cantilevered to the frame plate 70. The print head assembly 55 is similar in certain respects to a print head assembly disclosed in above-mentioned U.S. Pat. No. 5,833,377. A connector generally indicated at 121 fits into a slot 122 in an elongate metal mounting member 123. Upstanding spring fingers 124 have projections 125 that are releasably engaged with the upper surface 123' of upstanding flange 123" of the plate 123. An elongate metal plate or heat sink 126 releasably mounted and located with respect to the connector 121. The heat sink 126 mounts the elongate thermal print head 55' which extends in the same direction as the elongate member 123. The plate 123 has a pair of spaced platforms 126' with upstanding tangs 127. The springs 128 act on the platforms 126'. A pair of print head pressure adjusting devices 129 act on the springs 128 to adjust the spring forces exerted on the platforms 126'. The adjusting devices 129 are constructed like those shown in U.S. Pat. No. 5,833,377. The plate 123 also has a flange 126" received in an enlarged opening 120' (FIG. 11) in the housing 120. The flange 126" is shown to be spaced from the bottom of the opening 120' as viewed in FIG. 11. The flange 126" limits the movement of the print head 55' in the downward direction (FIG. 11) when the platen roll 56 is moved to its rest position as shown in FIG. 3. A ball-shaped member 133 received in a spherical socket 133' enables the connector 121, the plate 123 and the print head 55' to pivot so that when the platen roll 56 is moved into the FIG. 11 position, the springs 128 yield and the flange 126" is raised above the bottom of the opening 120'. In this position the print head 55' is in printing cooperation with the platen roll 56.

Figure 11:
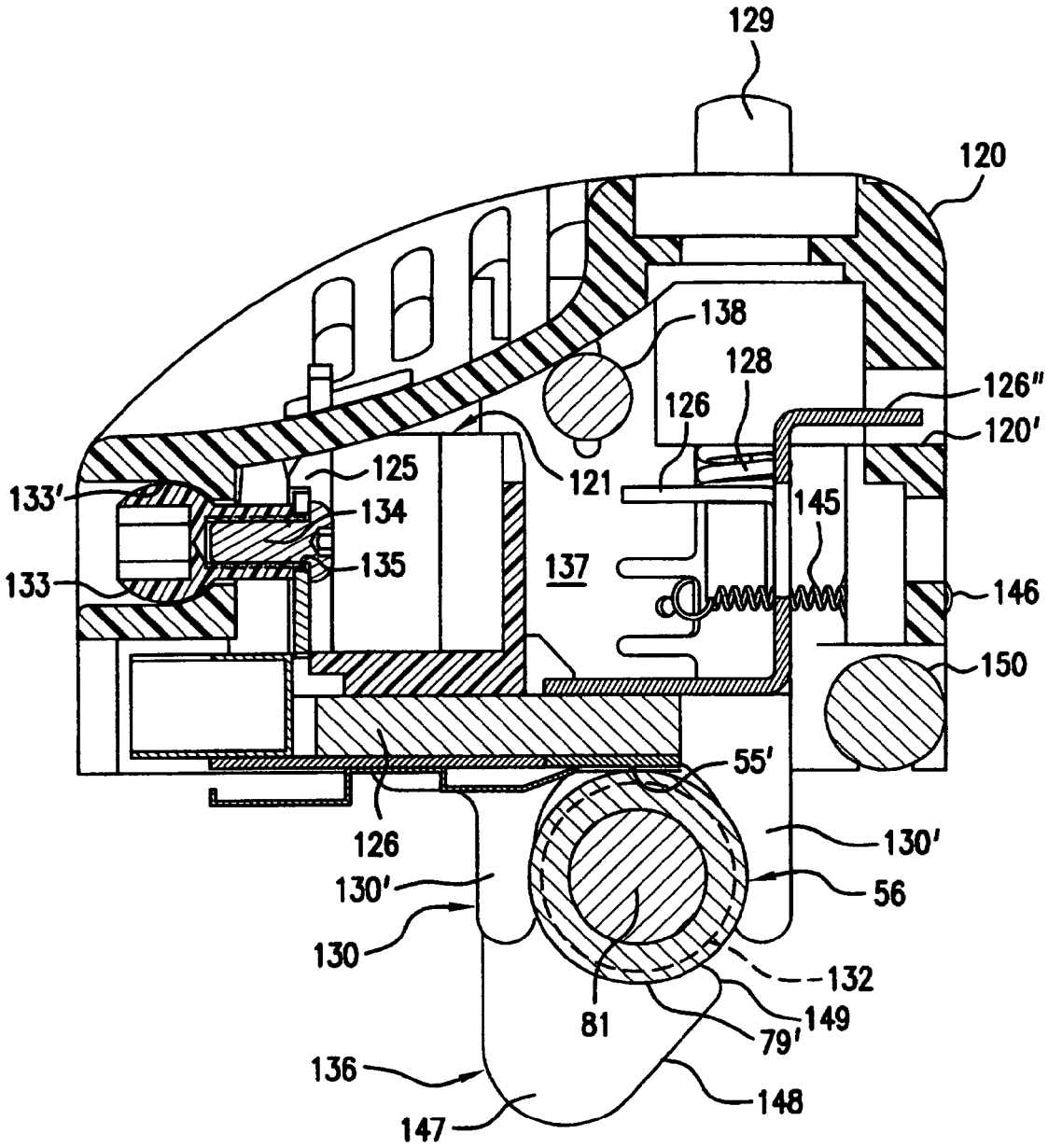
FIG. 11 is an enlarged sectional view taken along line 11—11 of FIG. 12.
Figure 12:
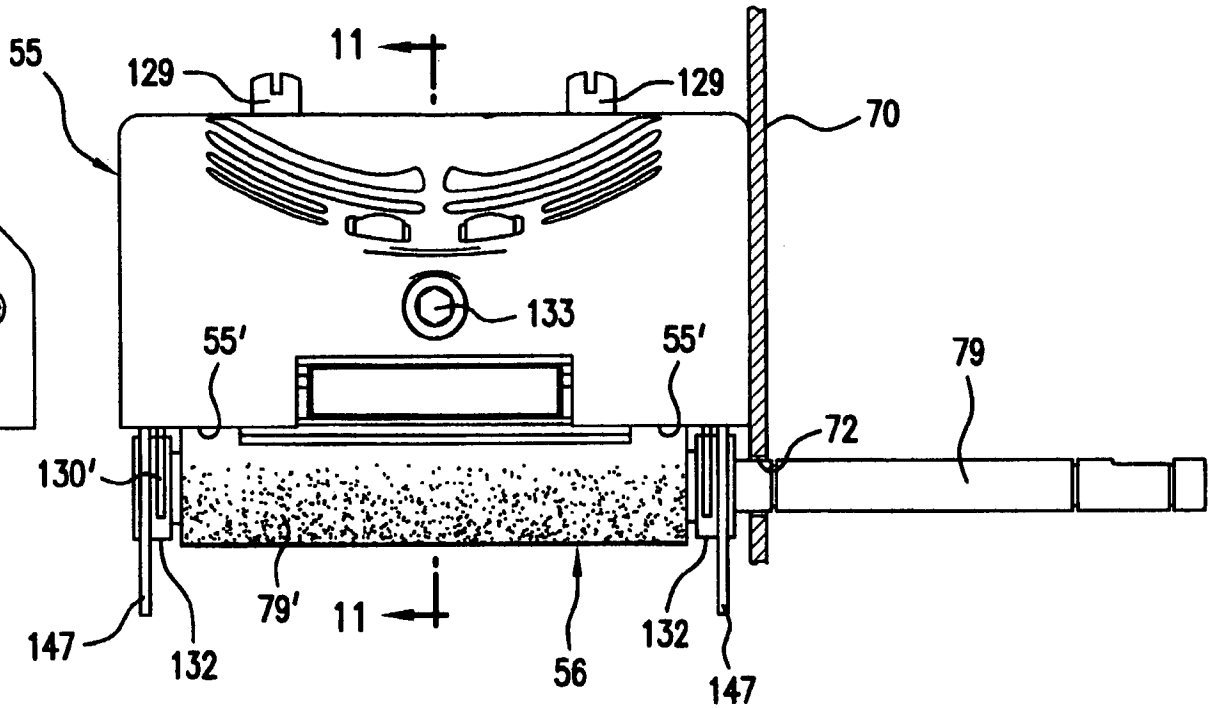
FIG. 12 is an elevational view of a print head assembly latched in printing cooperation with a platen roll.
Figure 13:
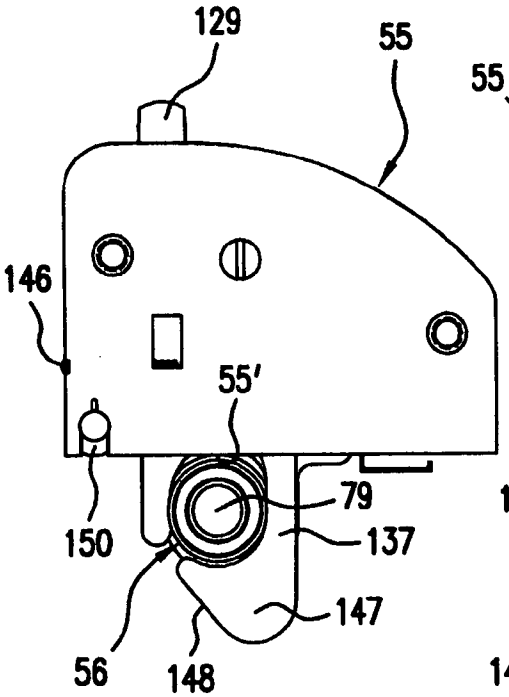
FIG. 13 is a left side elevational view of the print head assembly and platen roll of FIG. 12.

The plate 123 also has a pair of forked locators 130 each having depending locating members 130'. Each locator 130 has a pair of guide walls 131. Each pair of guide walls 131 receives a bearing 132 on the shaft 79 (or 87) to locate the platen roll 56 (or 54) with respect to the print head 55' (or 53') as seen in FIGS. 11 through 13. The bearings 132 are disposed outboard of the respective sleeves 79' and 87'.

A latch generally indicated at 136 (FIG. 10) includes a pair of spaced latch members 137 shown to be connected by a rod 138. The rod 138 is solid except for threaded holes 139 in each end. Each end of the rod 138 terminates in a pair of spaced projections 140. The projections 140 are received in notches 141 in the latch members 137. The notches 141 open into a central hole 142. A pair of pivot screws 143 pass through the holes 142 and are threaded into the holes 139. The holes 142 receive pivot portions 143'. The projections 140 key the latch members 137 in aligned relationship to the rod 138 so that the rod 138 and the latch members 137 can rotate as a unit or in unison about the pivot portions 143'. Each latch member 137 has a hole 144 for receiving one end of a tension spring 145. Each spring 145 passes through the housing 120 and is retained by a pin 146 which passes through the other end of the spring 145 and bears against the outer surface of the housing 120. The springs 145 urge the latch 136 clockwise as viewed in FIGS. 10 and 13 and counterclockwise as viewed in FIG. 11. The latch members 137 have end portions 147 that cooperate with and grip the bearings 132 to releasably hold the platen roll 56 (or 54) in printing cooperation with the print head 55' (or 53'). The bearings 132 can be considered to be part of the platen rolls 54 and 56. The end portion 147 of each latch member 137 has a cam surface 148. When the platen roll 56 (or 54) is manually pivoted from the inoperative position into the operative or printing position in printing cooperation with the print head 55' (or 53'), the bearings 132 simultaneously act on cam surfaces 148 to cam the latch members 137 counterclockwise as viewed in FIGS. 10 and 13 until the bearings 132 clear high point 149, whereupon the springs 145 pivot the latch members 137 as a unit to the latched position shown in FIGS. 11 through 13. The platen roll 56 (or 54) remains latched until the user grasps one of the latch members 137 and moves the latch 136 against the force of the springs 145 to a position where the high point 149 is clear of the bearings 132, thereby releasing the platen roll 56 (or 54) from the latch 136. While it is preferred to have two spaced latch members 137 to support the shaft 79 (or the shaft 87), it is within the scope of the invention to employ only one latch member 137. The housing 120 also rotatably mounts a roll 150 that is used to guide the ink ribbon I. The housing 120 also mounts an adjustable pot 120' for controlling the amount of power delivered to the print head 55'.

Figure 14:
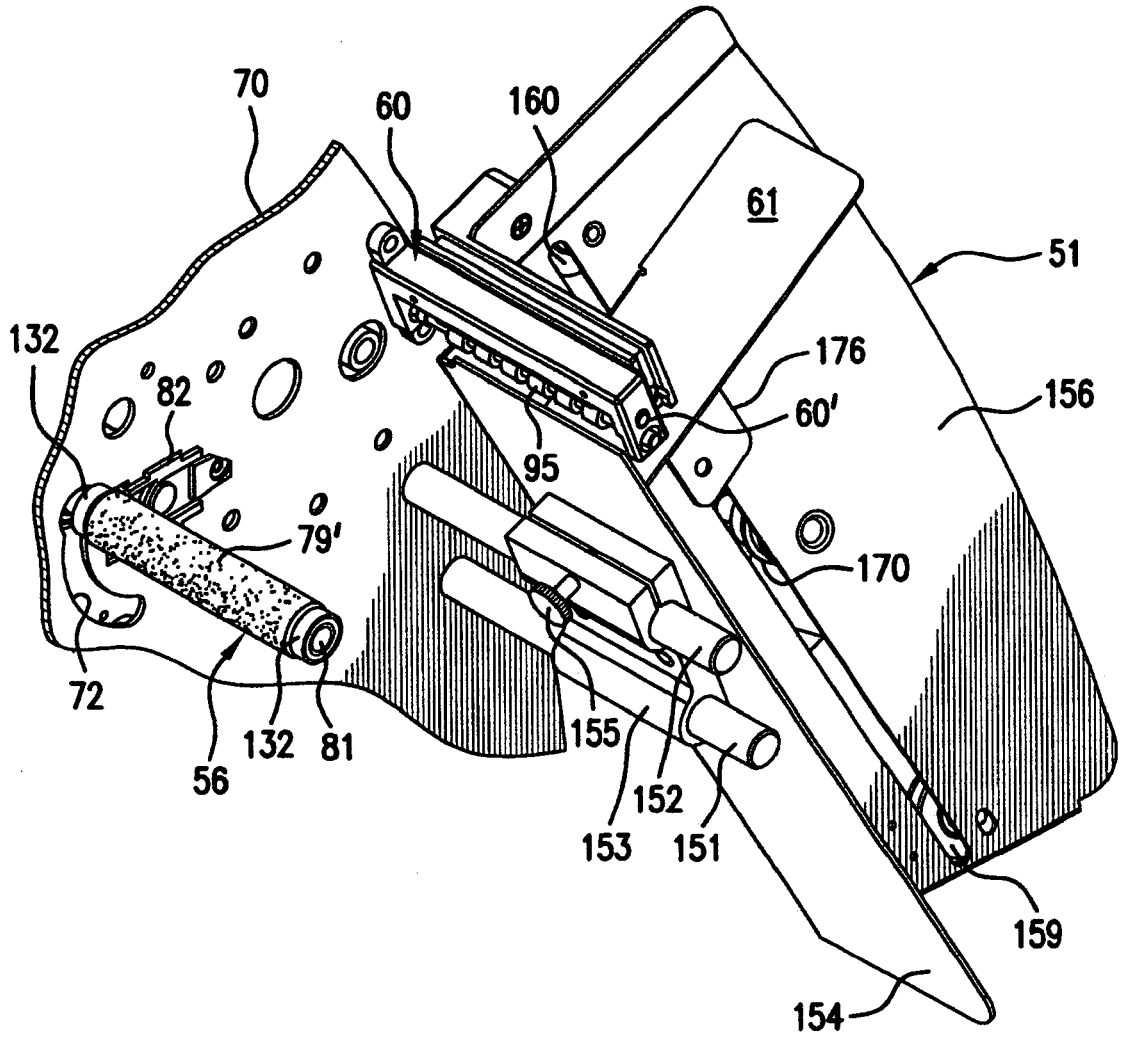
FIG. 14 is a fragmentary perspective view of the printer and the stacker.

With reference to FIG. 14, a pair of parallel horizontal shafts 151 and 152 are cantilevered perpendicularly to the vertical frame plate 70. A bracket 153 attached to a side wall 154 includes a thumb cap screw 155. When the screw 155 is loosened, the entire stacker 51 can be adjusted laterally to the longitudinal path of movement of the web W. Tightening of the screw 155 holds the stacker 51 in its adjusted position. The stacker feeder 60 which includes the driven feed roll 95 is cantilevered to the frame plate 70. The side wall 154 extends downwardly and outwardly away from the printer 50 as also shown in FIG. 1.

Figure 15:
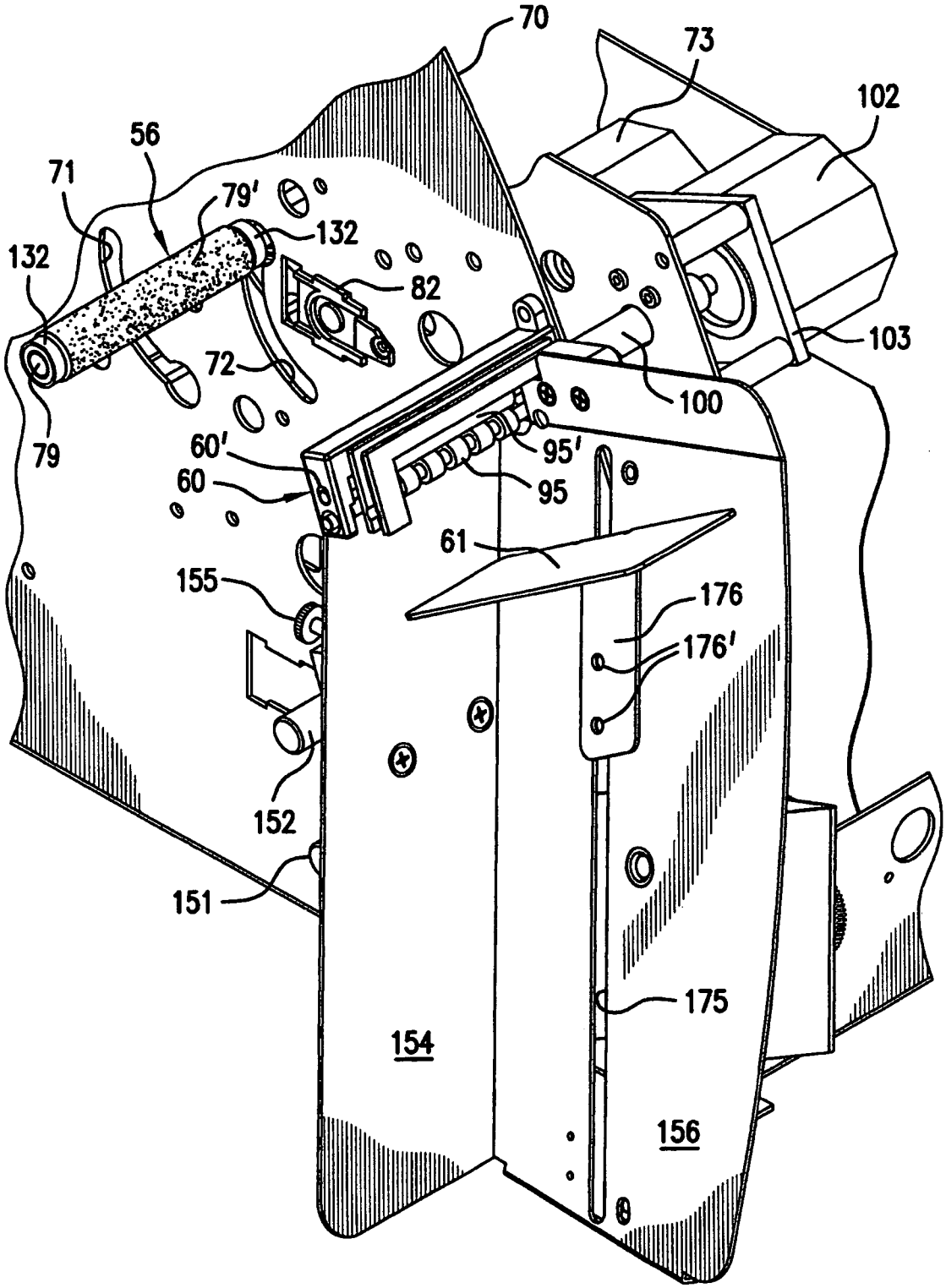
FIG. 15 is another fragmentary perspective view of the printer and the stacker.
Figure 16:
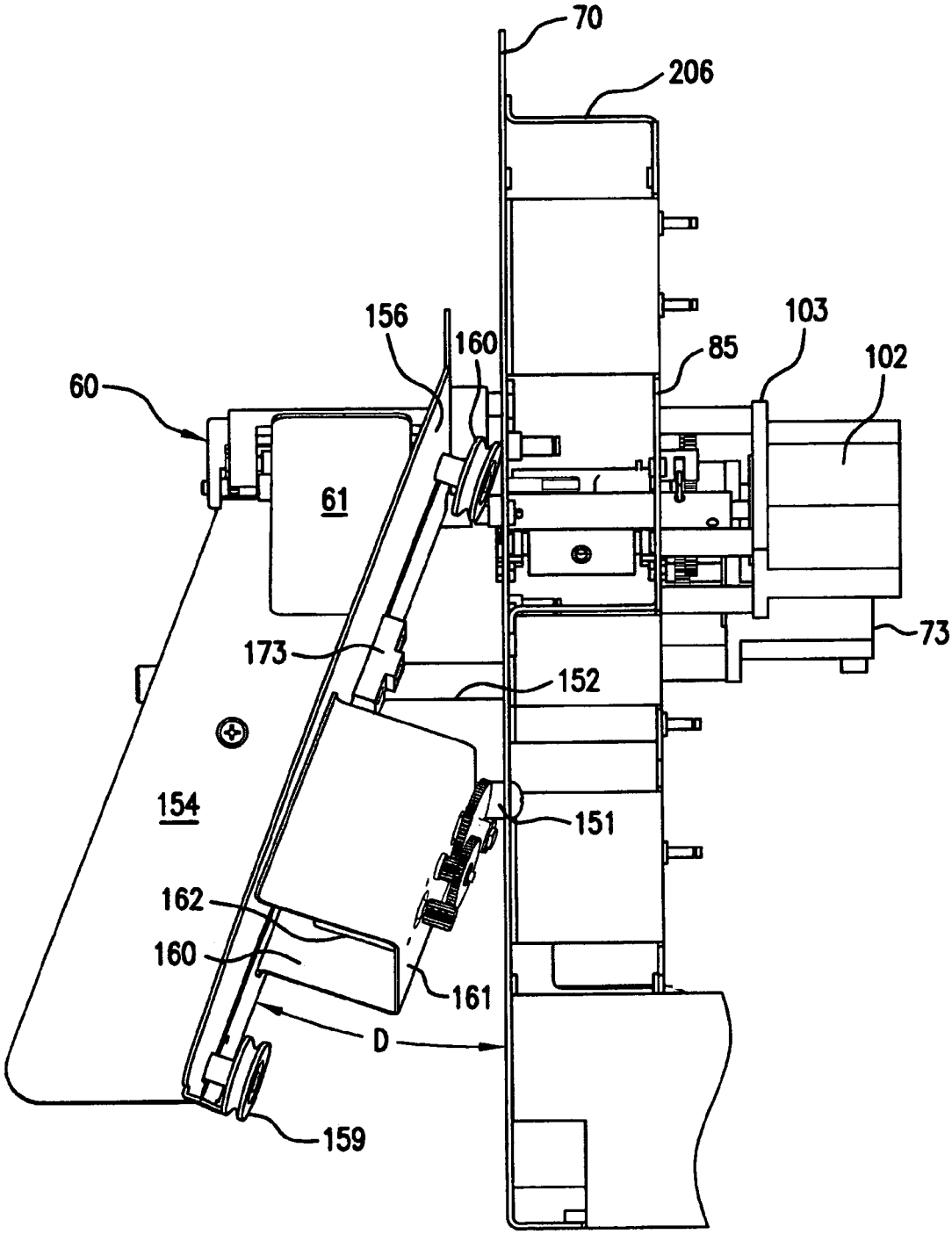
FIG. 16 is an elevational right side view of the printer and stacker shown in FIG. 1.
Figure 17:
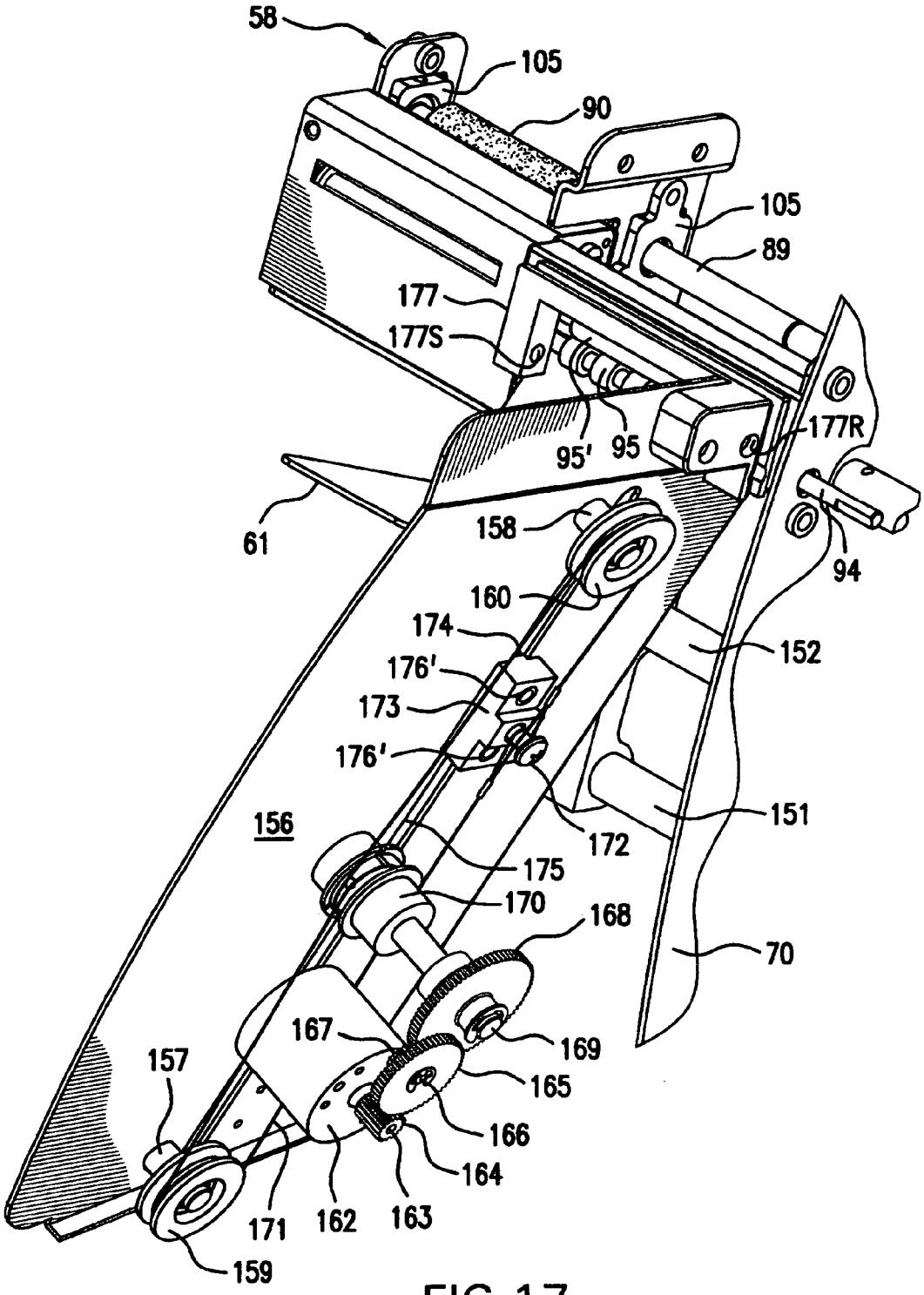
FIG. 17 is another fragmentary perspective view of the printer and the stacker.

FIG. 16 shows the inclination of a rear plate 156 which extends downwardly and forwardly away from the frame plate 70. Referring to FIGS. 16 and 17, pulley wheels 159 and 160 are shown to be rotatably mounted on the shafts 157 and 158 mounted on rear wall 156. A U-shaped bracket 160 has a bight 161 to which an electric motor 162 is secured. A gear 164 is secured to output shaft 163 of the motor 162. The gear 164 meshes with a gear 165 on a shaft 166. Another gear 167 on the shaft 166 meshes with a gear 168 on a shaft 169. The shafts 166 and 169 are rotatably supported by the bight 161 of the bracket 160 (FIGS. 7 and 16). A capstan 170 is secured to the shaft 169. A belt or cable 171 passes partly around the pulley wheels 159 and 160 and each looped end is connected to a post 172 of a slide 173. The cable 171 is wrapped around the capstan 170 three times, so operation of the stepping motor 162 drives the capstan 169 to drive the cable 171. The cable 171 is only shown to be wrapped about the capstan 170 once in FIG. 17 and the cable 171 is omitted in FIGS. 7 and 16 for the sake of clarity of illustration. The slide 173 has a ridge 174 guided in a slot 175 in the plate 156. The platform 61 includes a depending mounting member 176 (FIG. 15) secured to the slide 173 by screws 176' passing through the slot 175. The slide 173 guides the platform 61 for movement along the slot 175. A sensor 177 (FIG. 17) controls the position of the platform 61 and the height of the stack S. The sensor 177 has a sender light emitting diode 177S and one receiver or sensor 177R disposed on opposite sides of the label path. The diode 177S and the receiver 177R are disposed along a horizontal line above the top of the platform 61. If there is no label L on the platform at the beginning of operation, the receiver 177R receives the maximum amount of light from the diode 177S, which causes a signal from the receiver 177R to trigger the software to operate the stepping motor 162 to bring the platform 61 to its initial position close to the roll 95. As labels L accumulate on the platform 61, the amount of light received by the receiver 177R diminishes. When a threshold is reached because insufficient light is received by the receiver 177R, it means that the stack S needs to be lowered and a signal from the receiver 177R triggers the software to in turn energize the stepping motor 162 to lower the platform 61 and the stack S. The stack S will be moved down in response to a signal from the receiver 177R as every two to four labels are added to the stack S. The top of the stack S should be close to the underside of the roll 95. When the user desires to remove the stack S from the platform 61, the user will stop the printer 50. Upon restarting the printer 50, the receiver 177R will again receive the maximum amount of light which will trigger the software to energize the motor 162 to raise the platform to its operational position.

Figure 18:
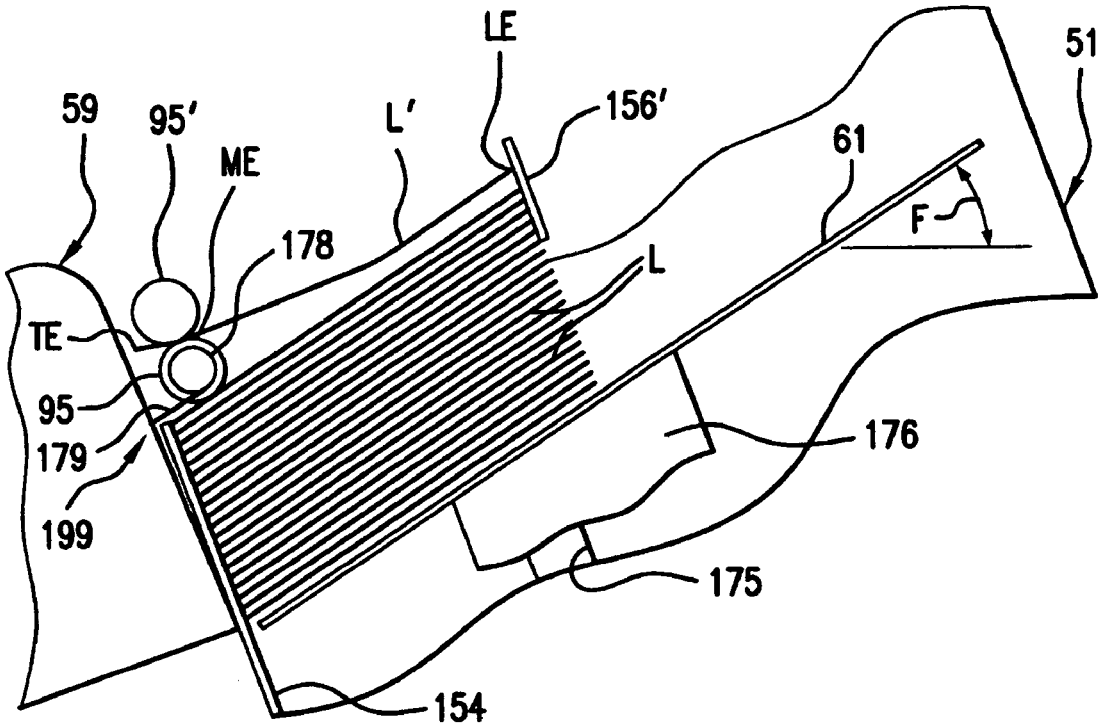
FIG. 18 is a diagrammatic elevational view showing a label being fed into the stacker and onto the top of the stack.

With reference to FIG. 18, there is shown a stack S of labels L on the platform 61 of the stacker 51. A label L' is shown being fed by and between the stacker rolls 95 and 95'. The driven feed roll 95 contacts the underside of the label L'. The stacker feed roll 95 is driven whereas the cooperating roll 95' is an idler or non-driven roll. Opposite ends of the roll 95' are mounted in elongate slots 60' (FIGS. 14 and 15) so that the roll 95' can be raised against gravity by the label L as it passes between the nip of the rolls 95 and 95'. FIG. 18 shows the trailing marginal end ME of the label L' at the nip of the rotating rolls 95 and 95', and shows the leading end LE against an adjustable stop 156'. The stop 156' is slidably positionable along top edge 156" of the rear wall 156 (FIG. 1). When the leading end LE contacts the stop 156' the label L' buckles slightly. Because the roll 95 continues to rotate, the roll 95 contacts the trailing marginal end ME at the upper surface of the label L' to cause the label L' to be fed in the reverse or retrograde direction until the trailing end TE abuts or contacts the side wall 154. This retrograde movement also helps to settle the label L' on top of the stack S. As shown, the stacker feed roll 95 has spaced annular grooves 178 (FIGS. 7, 14, 15, 17 and 18). A comb or stripper tines 179 project into the grooves 178 to prevent the label L' from wrapping around the roll 95. For labels L comprised of various materials e.g. those composed of fabric, it has been found that the stop 156' can be eliminated. Nevertheless, the rolls 95 and 95' function in the same manner as described above, namely, to feed incoming labels L' one-by-one onto the stack S and to feed the label L' in a retrograde direction with the trailing end TE fed by the feed roll 95 into abutment with the wall 154.

It is preferred that the stacker 51 have an open front so that it is easy to access and unload a stacker S of the labels L. The side wall 154 is preferably at an angle of about 72 degrees with respect to the vertical is indicated in FIG. 1 at B. The rear wall 156 is preferably at an angle of about 20 degrees with respect to the vertical as indicated at D in FIG. 16. The platform 61 is sloped upwardly and outwardly away from the wall 154 at an angle F of about 35 degrees with respect to the horizontal, however, the platform 61 is not sloped with respect to the horizontal from front to rear.

While the stacker 51 is shown to cooperate with the printer 50, the printer 50 can be used as a stand-alone machine, if desired. If the printer 50 is initially provided without the stacker 51, there is no need for the stacker feed mechanism 60 (which is part of the stacker 51) or the belt 91 or the pulley wheels 91, 93, 96 and 98 or the shafts 89, 94, 97 or 99. In addition, if a rewinder (not shown) is provided to rewind the printed web W, the auxiliary feed mechanism 58 and the cutter 59 can also be eliminated.

Figure 19:
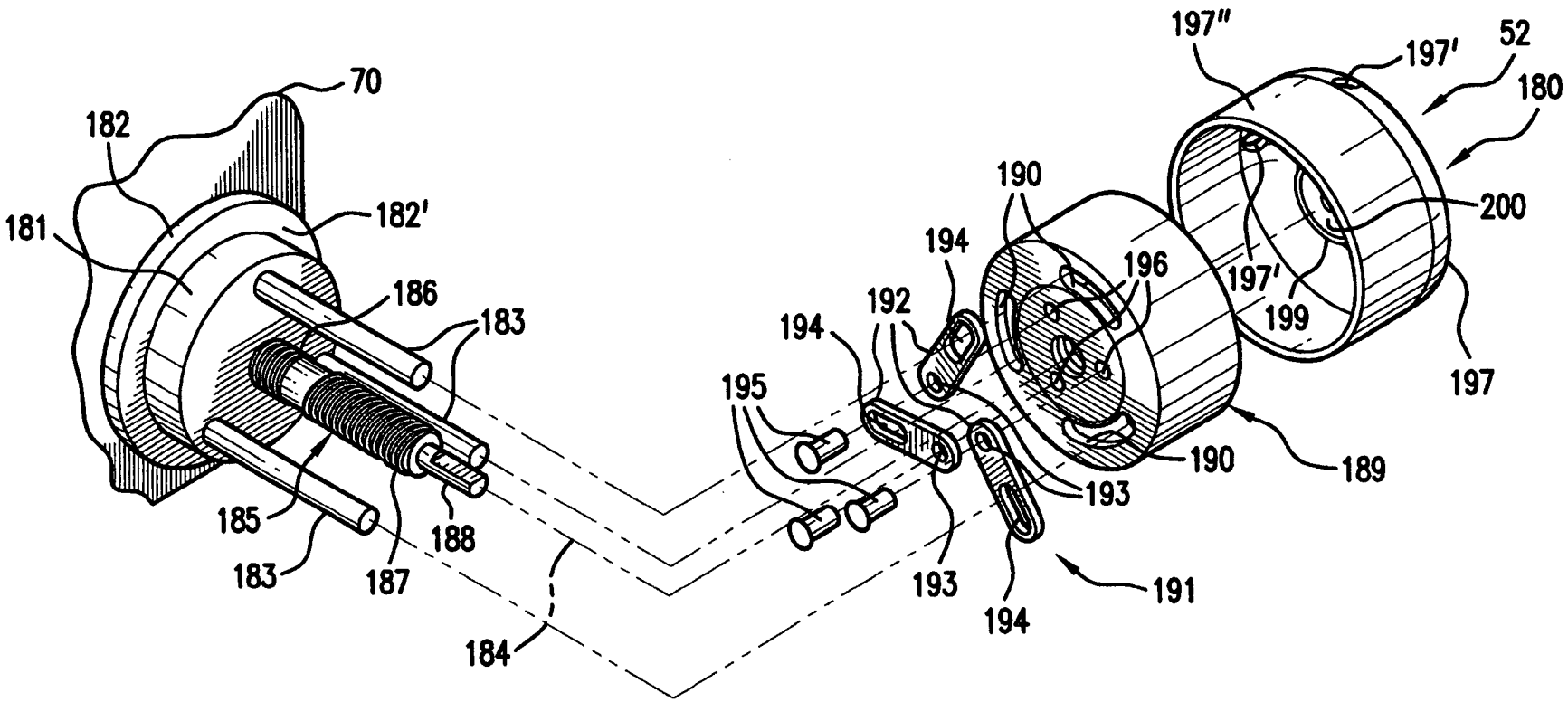
FIG. 19 is an exploded perspective view of portions of an unwind mechanism for a label supply roll.
Figure 20:
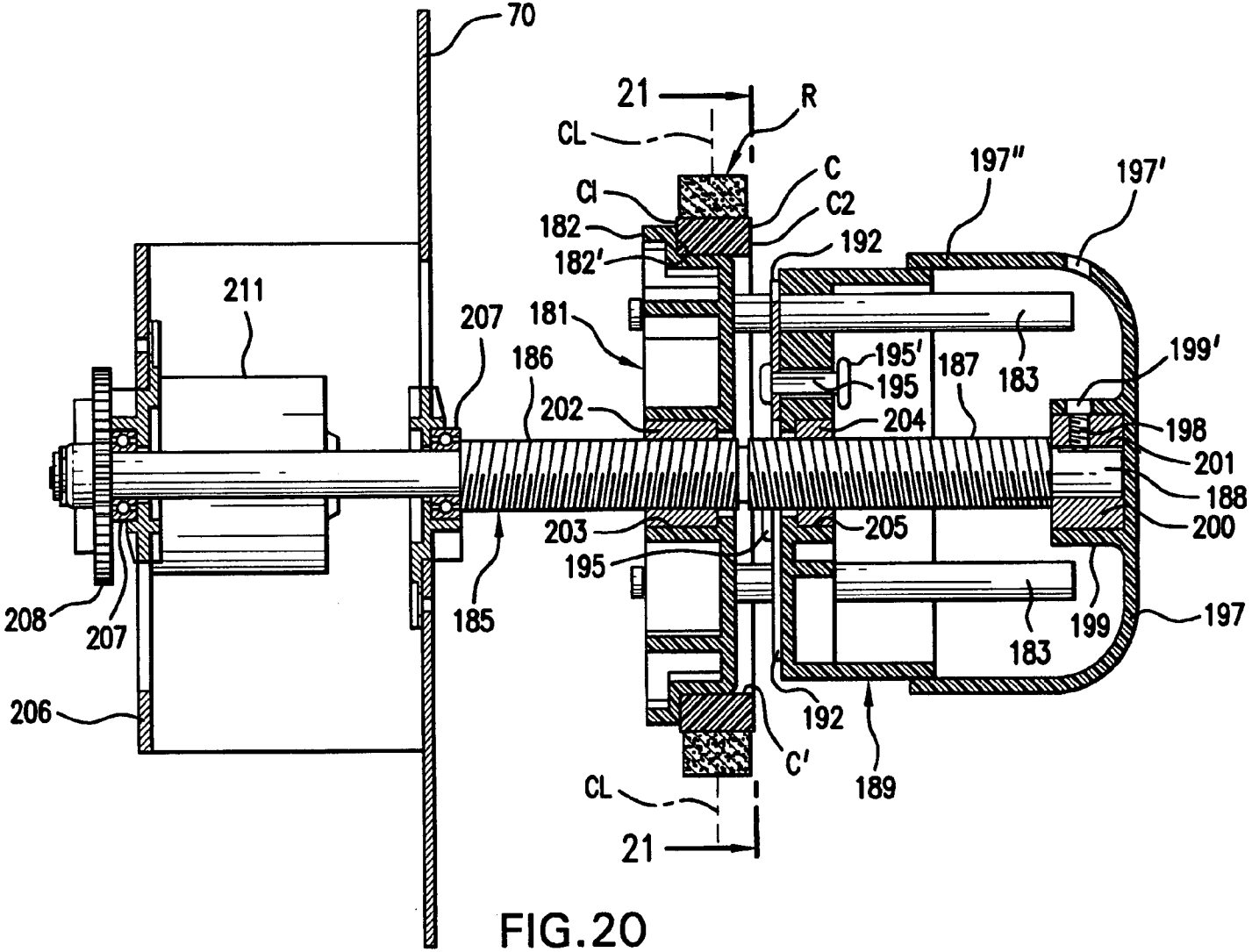
FIG. 20 is a sectional view of the unwind mechanism in its unclamped or loading (or unloading) position.

With reference to FIGS. 19 through 23, and initially to FIG. 19, there is shown a holder generally indicated at 180 which is part of the unwinder or unwind mechanism 52. The holder 180 is shown in FIG. 1 to mount the supply roll R. The holder 180 includes a hub 181 having a flange 182 providing a shoulder 182'. Projecting outwardly from and anchored in the hub 181 are three equally angularly spaced parallel rods or control members 183 equally spaced radially outwardly from axis 184 of the hub. A threaded member or shaft generally indicated at 185 is threadably received by the hub 181. The shaft 185 has a right-hand thread portion 186 with right-hand threads and a left-hand thread portion 187 with left-hand threads of equal pitch. A marginal end portion 188 of the shaft 185 is D-shaped. A handle or knob 197 is mounted on the end portion 188. A carrier generally indicated at 189 has a set of three equally angularly and radially spaced arcuate slots 190. A clamp 191 is shown to include three clamp members 192 having holes 193 at one end portion and slots 194 at the other end portion. The control members 183 extend through the slots 190 and 194. Pivots or studs 195 pass through holes 193 and are loosely-fitted into equally spaced-apart holes 196 in the carrier 189. The pivots 195 are known commercially as female "PEM" studs. Screws 195', one of which is shown in FIG. 20, are threaded into the pivots 195 and limit the axial movement of the pivots 195. The clamp members 192 are capable of pivoting about the pivots 195.

With reference to FIG. 20, the supply roll R is shown mounted on the annular outer periphery of the hub 181 against the shoulder 182' of the flange 182 and the clamp members 192 are retracted and spaced from the side of the supply roll R. The supply roll R has a web W of printable label supply material such as fabric, paper or plastic mounted on a central core C. The clamp members 192 can clamp the roll R at the core C or in the event the roll of the web W is coreless, the clamp members 192 can clamp the side of the web W which has been wound into the roll R. The knob 197 is shown to be secured to the end portion 188 by a set screw 198. The knob 197 is bell-shaped and has an annular tubular portion 197" shown to be rotatably received about and relative to a portion of the carrier 189, however, with a roll R wider than shown, the knob 197 can be beyond the end of the carrier 189. The inside diameter of the annular tubular portion 197" of the knob 197 is at least slightly greater than the outside diameter of the carrier 189. The knob 197 has an internal co-axial tubular portion 199 into which a metal tubular member or sleeve 200 is press-fitted. The set screw 198 is threadably received by the sleeve 200 and bears against a flat 201 on end portion 188. The knob 197 has radially extending holes 197' one of which is aligned with a hole 199' in the tubular portion 199 and with the set screw 198 to enable the set screw 198 to be rotated by an Allen wrench (not shown).

The hub 181 has a central internally threaded sleeve or nut 202 which is press-fitted into a central hole 203 in the hub 181. The nut 202 has right-hand threads to cooperate threadably with the right-hand threaded portion 186. The carrier 189 has a central internally threaded sleeve or nut 204 which is press-fitted into a central hole 205 in the carrier 189. The nut 204 has left-hand threads to cooperate threadably with the left-hand threaded portion 187. The threading on the threaded portion 186 and the nut 202 could be made left-handed and the threading on the threaded portion 187 and the nut 204 could be made right-handed, if desired.

It is apparent that rotation of the knob 197 relative to the hub 181 will cause the shaft 185 to rotate in the same direction because the knob 197 is keyed to the shaft 185. Rotation of the knob 197 relative to the hub 181 in one direction, namely, clockwise in FIG. 19, will simultaneously move the clamp members 192 from their retracted position (FIGS. 20 and 21) toward their extended position (FIGS. 22 and 23) and move the clamp members 192 toward side C2 of the core C of the roll R. Conversely, rotation of the knob 197 relative to the hub 181 in the opposite direction, namely, counterclockwise in FIG. 19 will simultaneously move the clamp members 192 from their extended positions toward their retracted positions. Once the clamp members 192 are in their extended positions, further clockwise rotation of the knob 197 will continue to advance the extended clamp members 192 toward the side of the roll R. Conversely, once the clamp members 192 are in their retracted positions, further counterclockwise rotation of the knob 197 moves the clamp members 192 away from the side of the roll R.

Figure 21:
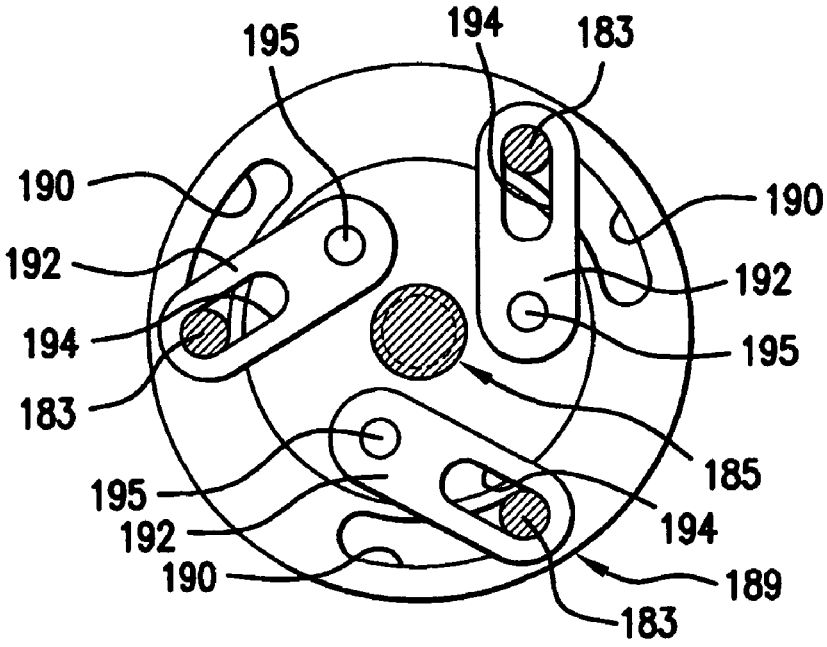
FIG. 21 is a fragmentary sectional view taken along line 21—21 of FIG. 20.

The maximum outside diameter of the knob 197 is at least slightly less than the diameter of inside C' of the core C (or the central hole of a coreless roll R) to enable the roll R to be slipped over the knob 197 and onto the hub 181 to a position wherein side C1 of the core C is against shoulder 182' of the flange 182. The clamp members 192 have a lesser outward extent in the retracted position than the carrier 189 as best shown in FIG. 21.

Figure 22:
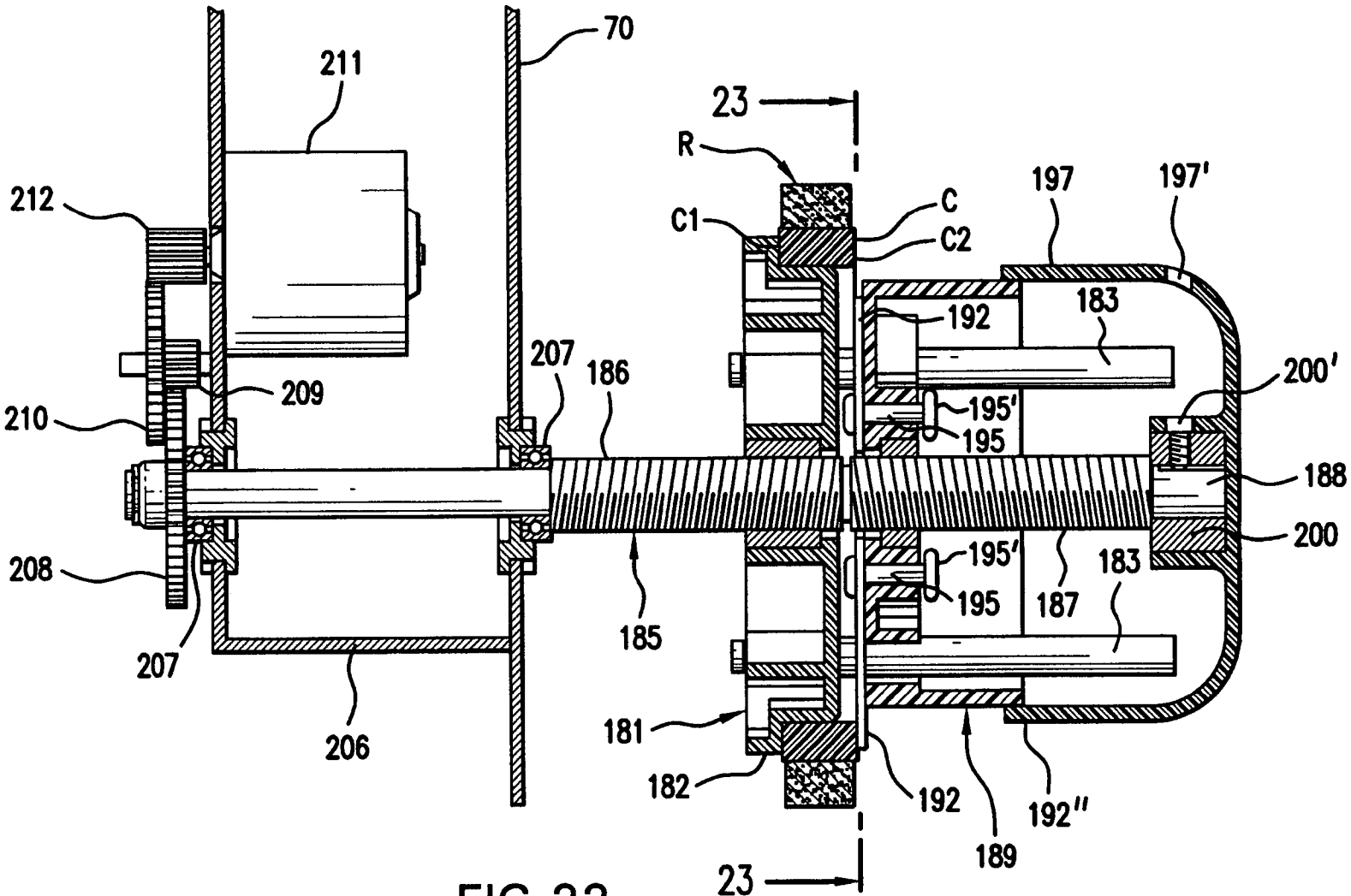
FIG. 22 is a sectional view of the unwind mechanism in its clamped position, and taken along a different plane from that shown in FIG. 20.

With reference to FIGS. 20 and 22, the shaft 185 is mounted in frame plate 70 and in standoff 206 in spaced bearings 207. A gear 208 secured to the shaft 185 meshes with a gear 209 (FIG. 22) secured to a gear 210. A d.c. motor 211 drives a gear 212 which meshes with gear 210. When energized, the motor 211 continuously attempts to rotate the shaft 185 in the counterclockwise direction (FIGS. 1 and 19) and this keeps the desired tension on the web W which has been threaded through the printer 50. When it is desired to clamp the clamp members 192 against the side of the roll R, the knob 197 is rotated clockwise relative to the hub 181 which simultaneously extends the clamp members from the FIG. 21 position to the FIG. 23 position and moves the hub 181 and the clamp members 192 equal distances toward each other simultaneously. When the clamp members 192 have been moved into clamping contact with the side of the roll R, the roll R is clamped between the shoulder 182' and the clamp members 192. The pitch of the threads in the threaded portions 186 and 187 is such that the clamp 191 is self-locking, that is, the clamp members 192 do not move apart from the shoulder 182' until the knob 197 is intentionally rotated in the counterclockwise direction relative to the hub 181 (FIG. 19).

The threads on the threaded portion 186 and 187 are the same except for being right-hand and left-hand types so the hub 181 and the clamp members 192 move the same distance toward or away from each other upon either clockwise or counterclockwise rotation, respectively, of the knob 197. If it is desired to move the hub 181 and the clamp members 192 toward and away from each other with lesser rotation of the knob 197, the pitch of the threads of the threaded portions 186 and 187 and the nuts 202 and 204 can be increased or these threads can be provided with a double or triple pitch, but preferably the pitch should be such as to prevent the clamped hub 181 and carrier 189 from accidentally moving apart and loosening the clamping of the roll R between the flange 182 and the clamp members 192. Although three clamp members 192 and rods 183 are illustrated, a lever member such as one or two of each can be used.

Figure 23:
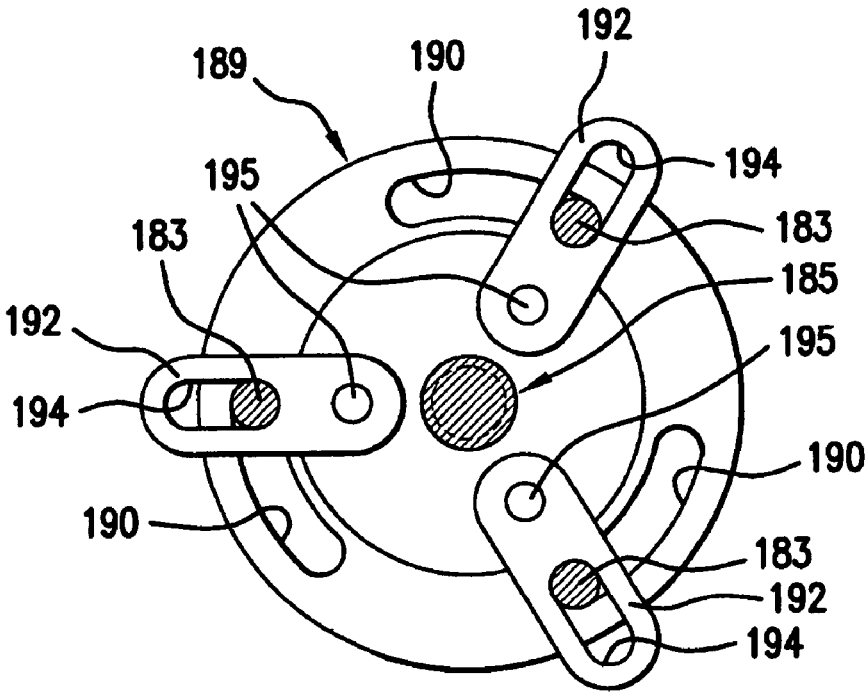
FIG. 23 is a fragmentary sectional view taken along line 23—23 of FIG. 22.

With reference to FIG. 23, if it is desired to unclamp the roll R, the knob 197 is rotated in the counterclockwise direction relative to the hub 181 and this causes the clamp members 192 to move to their retracted positions and causes the clamp members 192 and the carrier 189 to move apart relative to the hub 181 to the FIG. 19 position. It is apparent that the holder 180 can mount rolls of an infinite number of roll widths between limits. Irrespective of the width of the roll R, the roll R is always center-justified with respect to the print heads 53' and 55'. The centerline CL of the roll R is always the same irrespective of the width of the roll R. The centerline CL is also the same as the longitudinal centerline of the web W as it travels along its path through the printer 50 and the centerline of the ink ribbons I and the cores 66 on which the ribbons I are mounted. Therefore, the roll R, the ink ribbons I and cores 66, and the print heads 53' and 55' are all always along the same centerline CL, or center-justified. The illustrated roll R is relatively narrow. It is also apparent that the hub 181 and the clamp-carrying carrier 189 are coupled together. Nonetheless, limited relative rotational movement between the hub 181 and the clamp members 192 is permitted by the slots 190 in the carrier 189. The knob 197 and the clamp members 192 can have limited relative rotation, however, rotation of the knob 197 always moves the hub 181 on the one hand and the carrier 189 and clamp members 192 on the other hand toward or away from each other. The relative rotation between the hub 181 and the clamp members 192 makes it possible to move the clamp members 192 between their retracted and extended positions.

A method involves mounting a supply roll R on a hub 181, providing at least one clamping member 192 movable from a retracted position to an extended position along a side of the supply roll R and moving the clamp member(s) 192 and the hub 181 relatively toward each other to clamp the supply roll R to the hub 181. Thereafter, the clamp member(s) 192 can be moved from the extended position to the retracted position and relatively away from the hub 181. In the retracted position of the clamp member(s) 192, a spent or partially spent core C can be removed from supported relationship on the hub 181 and a new roll R can be loaded onto the holder 180.

Figure 24:
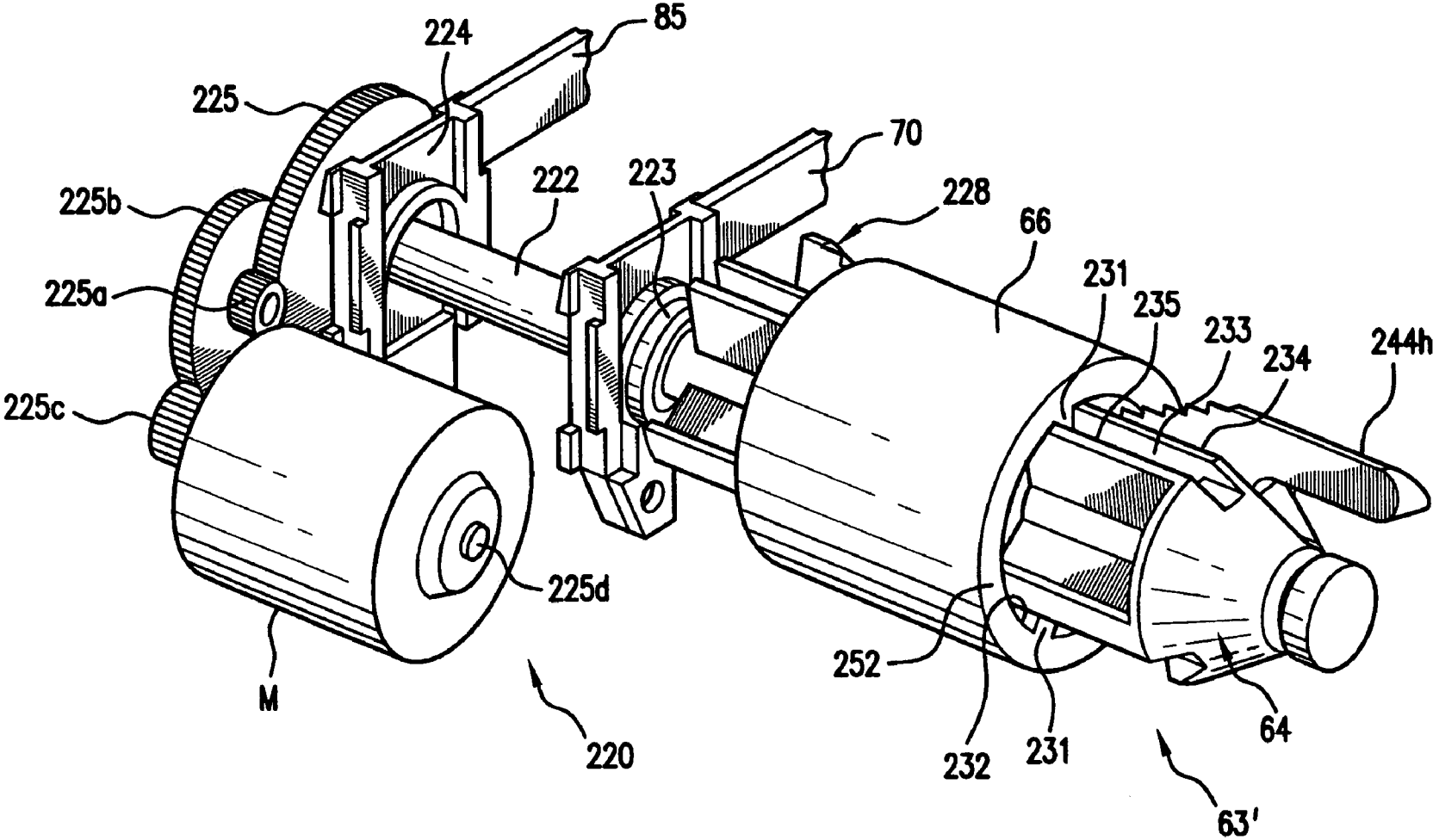
FIG. 24 is a perspective view of one of the four ink ribbon mechanisms of the printer, showing an ink ribbon core mounted on a spindle.
Figure 25:
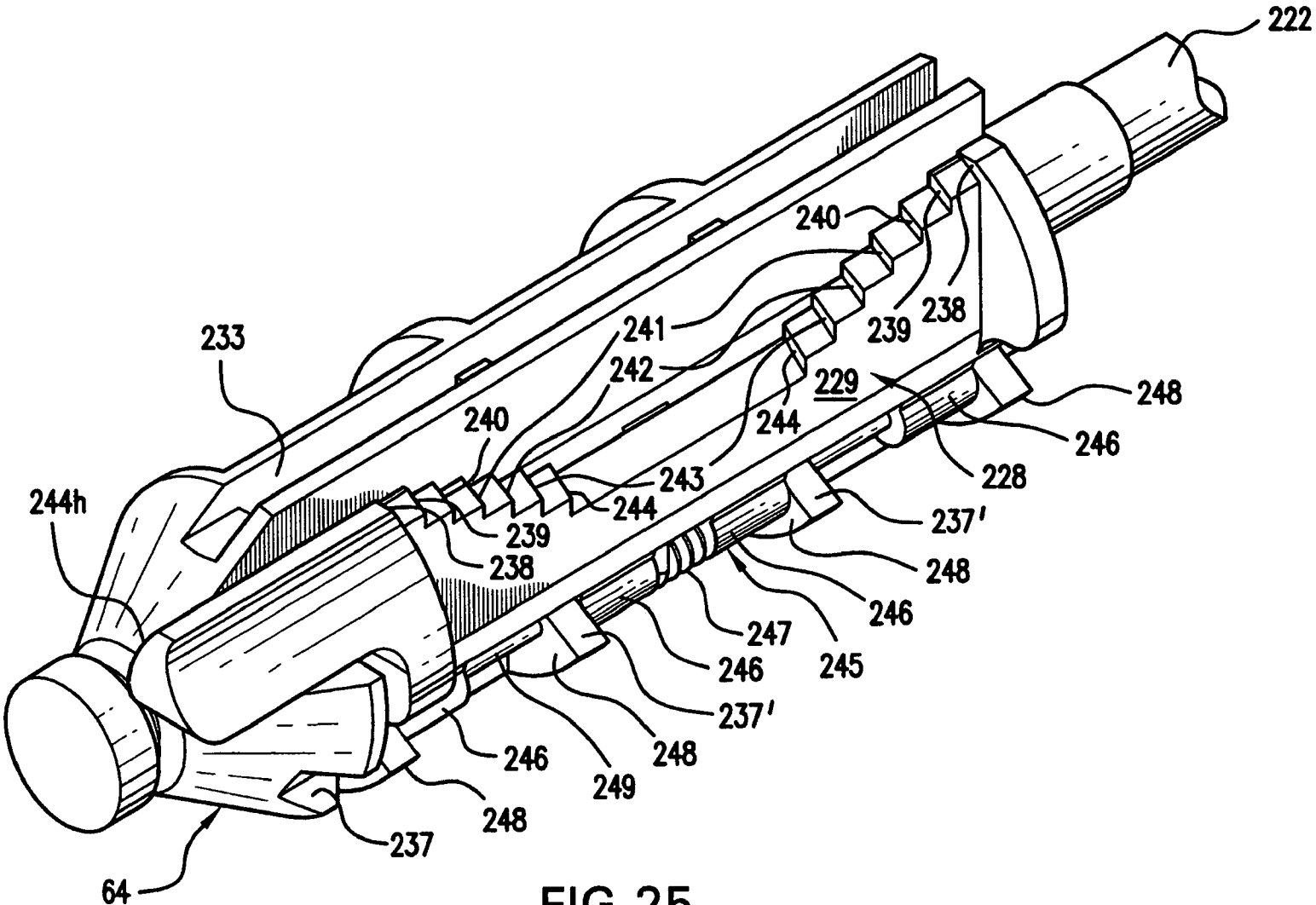
FIG. 25 is a perspective view of the spindle shown in FIG. 24.
Figure 26:
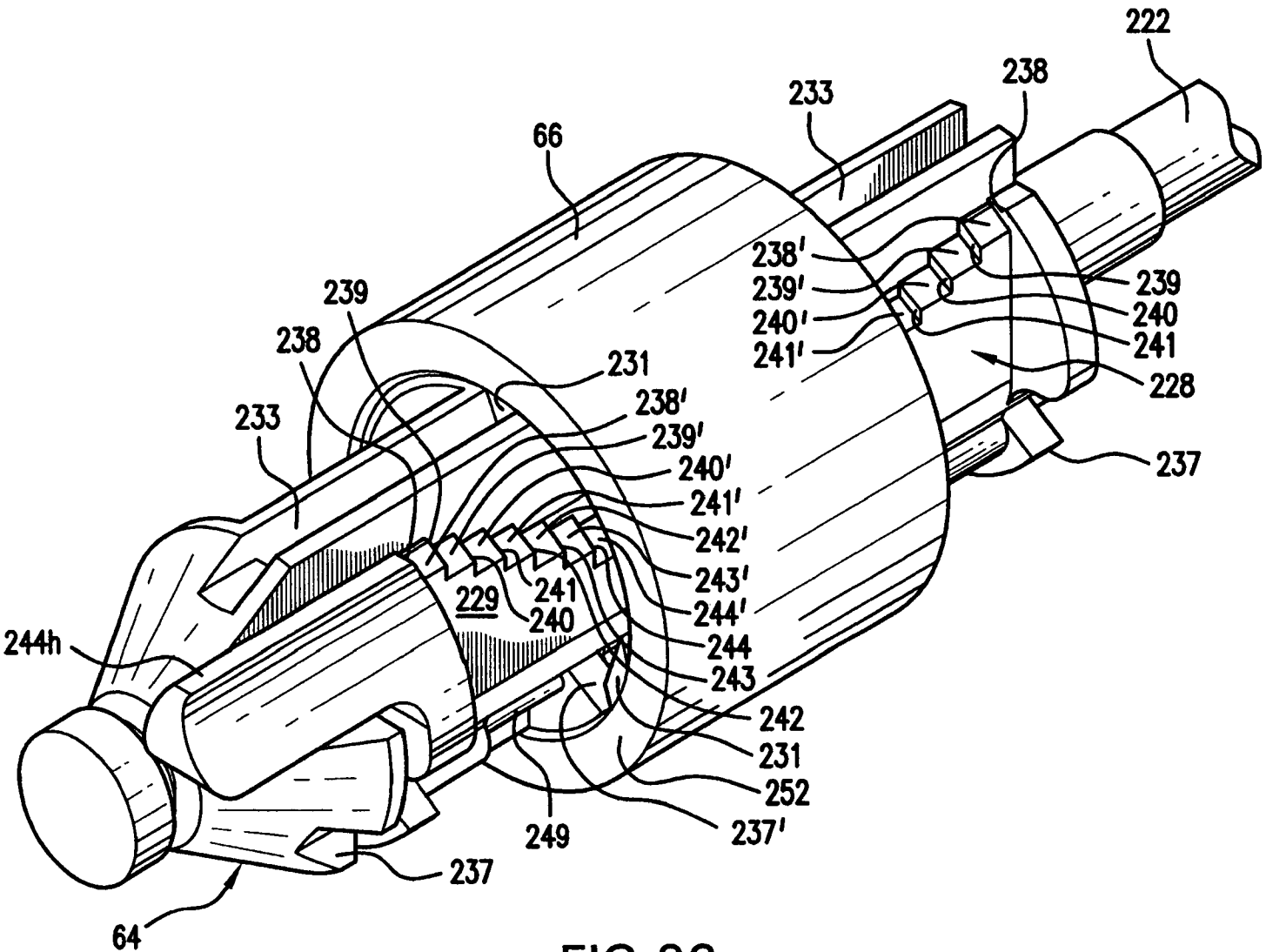
FIG. 26 is a perspective view of the spindle and a core received in the spindle.
Figure 27:
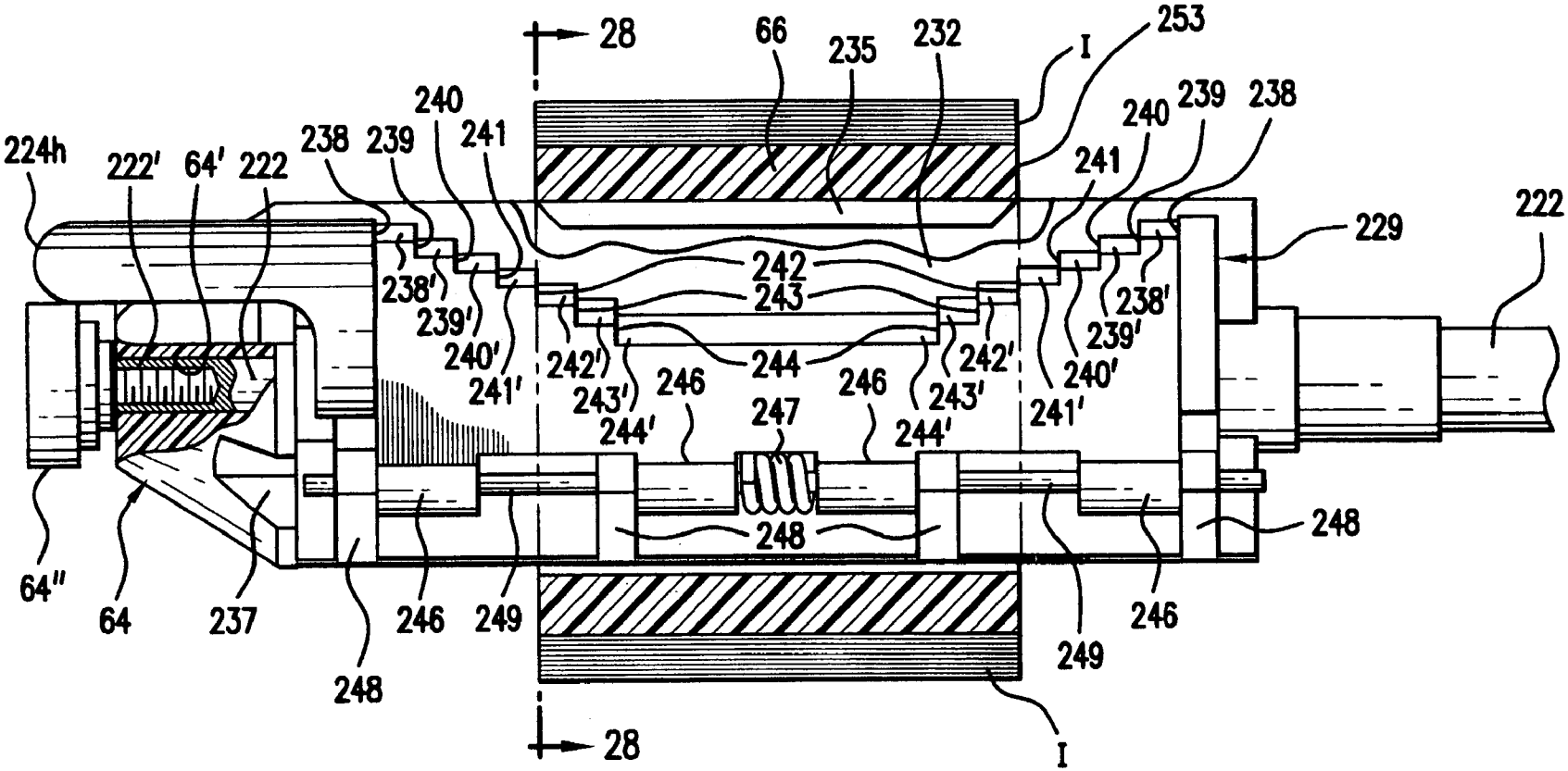
FIG. 27 is a partly fragmentary elevational view of the spindle and the core.
Figure 28:
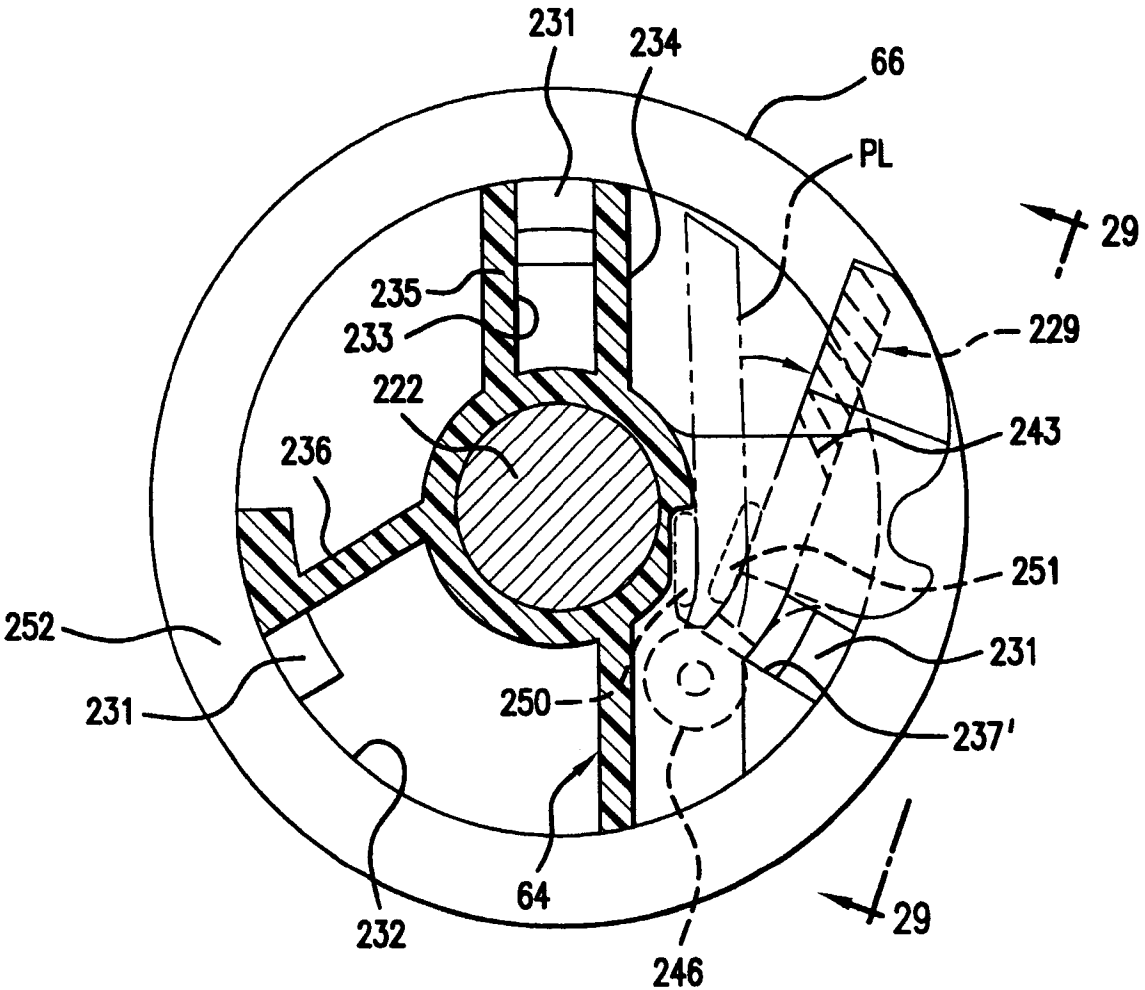
FIG. 28 is a sectional view taken along line 28—28 of FIG. 27.

With reference to FIGS. 24 through 30, there is shown one of the four ink ribbon mechanisms 220. FIGS. 24, 26 and 28 omit the wound ink ribbon I for clarity and simplicity. There are two such mechanisms 220 for each system 62 and 63.

Although the ink ribbon mechanisms 220 are identical in construction, they differ in function. The ink ribbon systems 62 and 63 (FIG. 1) each have a supply component 62' and 63' and a take-up component 62" and 63". The ink ribbon I passes from the supply component 63' (and 62' assuming the print head assembly 53 is being used). In each case the ink ribbon I is unwound from the core 66 on the supply spindle 64 and wound onto the core 66 on the take-up spindle 65. If the print head assembly 53 is not to be used, then the supply component 62' and the take-up component 62" are not used at all. Both systems 62 and 63 are microprocessor controlled as in U.S. Pat. No. 5,820,277.

The mechanism 220 is now described in structural detail with reference to system 63, for example the supply component 63'. The mechanism 220 includes a spindle generally indicated at 64 secured to a shaft 222 mounted in a bearing block 223 in turn mounted in the frame plate 70 and in a bearing block 224 in the standoff 85. The shaft 222 has a D-shaped end portion 222' received in a D-shaped hole 64' at an end portion of the spindle. The shaft end portion threadably receives a cap screw 64". The spindle 64 is on the same axis as the shaft 222. A gear 225 secured to the shaft 222 meshes with a gear 225*a* secured to a gear 225*b*. The gear 225*b* is driven by a gear 225*c* on shaft 225*d* of a direct current motor M. The purpose of the motor M is to apply a force to the spindle 64 to maintain tension in the ink ribbon I. The spindle 64 is received in and mounts the core 66 onto which a supply of ink ribbon I (FIGS. 1 and 27) has been wound. The core 66 has three equally spaced, longitudinally extending splines or ribs 231 projecting radially inwardly from its inner surface 232 as best shown in FIG. 28 which key the core 66 against rotation to the spindle 64. One rib 231 projects into a groove 233 between two walls 234 and 235. Another of the ribs 231 contacts one side of a generally radially extending member 236, and the remaining rib 231 is received in a groove 237 and against ledges 237' (FIG. 25). While the core 66 can be slid onto the spindle 64 from the right hand end of FIG. 24, the core 66 is keyed to the spindle 64 and is thus incapable of rotating relative to the spindle 64.

Figure 29:
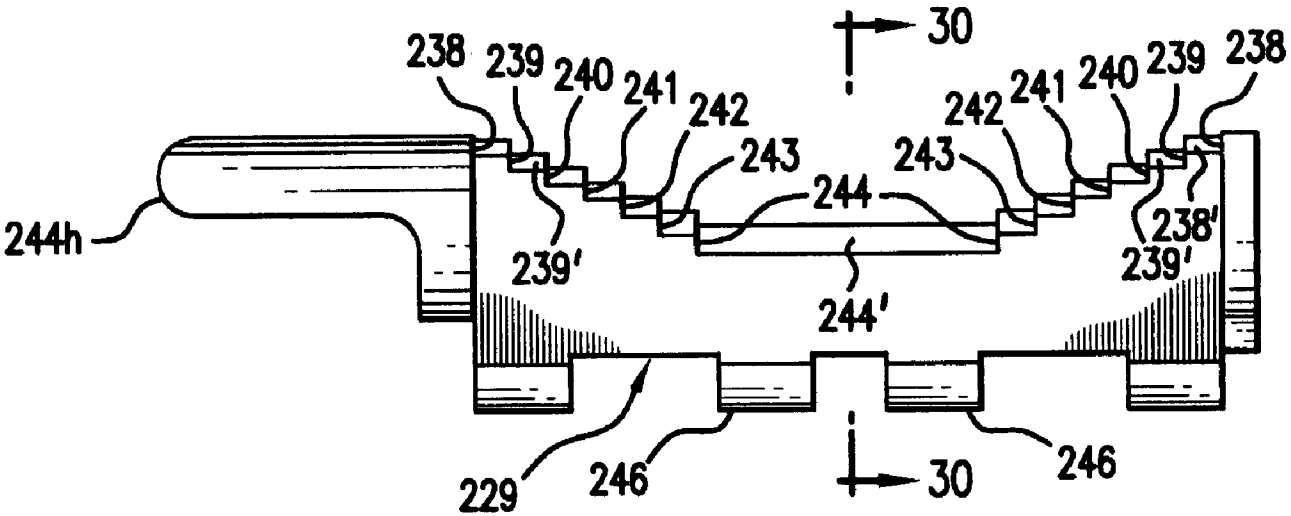
FIG. 29 is a view of a latch or detent of the spindle taken generally along line 29—29 of FIG. 28.
Figure 30:
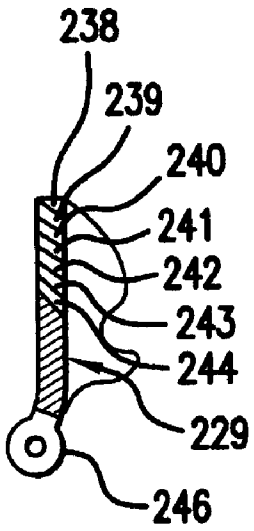
FIG. 30 is a sectional view taken along line 30—30 of FIG. 29.

As shown in FIG. 25, for example, a latch or detent generally indicated at 228 is pivotally mounted on and adjacent to the spindle 64. The latch 228 is shown to include a generally flat latch member 229 having pairs or sets of connected stepped shoulders 238 through 243. A greater or lesser number of shoulders can be provided, if desired. The latch member 229 also has an outwardly extending manually engageable handle 244*h*. The latch member 229 has a hub 245 comprised of preferably four spaced hub portions 246. A spiral spring 247 is disposed axially between the two inboard hub portions 246. The spindle 64 has preferably four spaced projections 248. A pivot pin or shaft 249, extending parallel to the spindle axis, is mounted in the projections 248 and passes through the hub members 246 and the spiral spring 247. The pivot pin 249 mounts the latch member 229 for limited pivotal movement on the spindle 64 in opposite directions transverse to the spindle axis, and the spring 247 biases the latch member 229 clockwise as viewed in FIGS. 25 and 28 for example. The spring 247 has an end portion 250 which bears against the spindle 64 and an end portion 251 which bears against the latch member 229. The latch member 229 is thus biased by the spring 247 against the inner surface 232 of the core 66. When the core 66 has been moved onto the spindle 64 to a position in which one set or pair of shoulders of the sets or pairs 238 through 243 is just slightly beyond both ends or end faces 252 and 253 of the core 66, the spring 247 pivots the detent member 229 clockwise (FIGS. 25 AND 28) until the core 66 is straddled by one pair of the shoulders 238 through 243. For example, the widest core 66 would fit between and be straddled by opposed shoulders 238, while a narrowest core would fit between and be straddled by opposed shoulders 239. It is preferred that the shoulders 238 through 243 be sloped as best shown in FIGS. 28 through 30 so that lands 238' through 243' fit against the curved inner surface 232 of the core 66. As best shown in FIGS. 27 and 30, the slopes of the lands 238' though 244' increase the closer these lands are to the axis of the shaft 249. For example, the slope of the land 244' is greater than the slope of any of the other lands 238' through 243, the slope of the land 243' is less than the slope of the land 244' but is greater than the slope of any of the lands 238' through 242', and so on, to enable each of the lands 238' through 244' to match the curvature of the inside surface 232 of the core 66. To release the latch member 229, the user grasps the handle 244*h* and pivots the latch member 229 counter-clockwise to the phantom line position PL shown in FIG. 28 for example to release the latch 228 from the core 66 to thereby uncouple the core 66 from the spindle 64 and to enable the core 66 to be slid off the spindle 64.

A method involves providing a spindle such as the spindle 64 and two sets of pairs of connected shoulders 238 through 243 mounted on the spindle 64, wherein the spindle 64 is capable of mounting supply roll cores 66 of different widths with ink ribbons I of different widths wound respectively thereon, and moving the pair of shoulders 238 through 243 that correspond to a core 66 of a predetermined width into straddling relationship to the ends of the core 66 when the core 66 is center-justified with respect to the spindle 64. It is preferred to spring-bias one pair of the shoulders 238 through 243 into straddling relationship with opposite ends 252 and 253 of the core 66.

When it is desired to remove the core 66 from the spindle 64, it is preferred to move the pairs of shoulders 238 through 243 out of straddling relationship with the ends 252 and 253 of the core 66 and slide the core 66 out beyond the end of the spindle 64.

Figure 31:
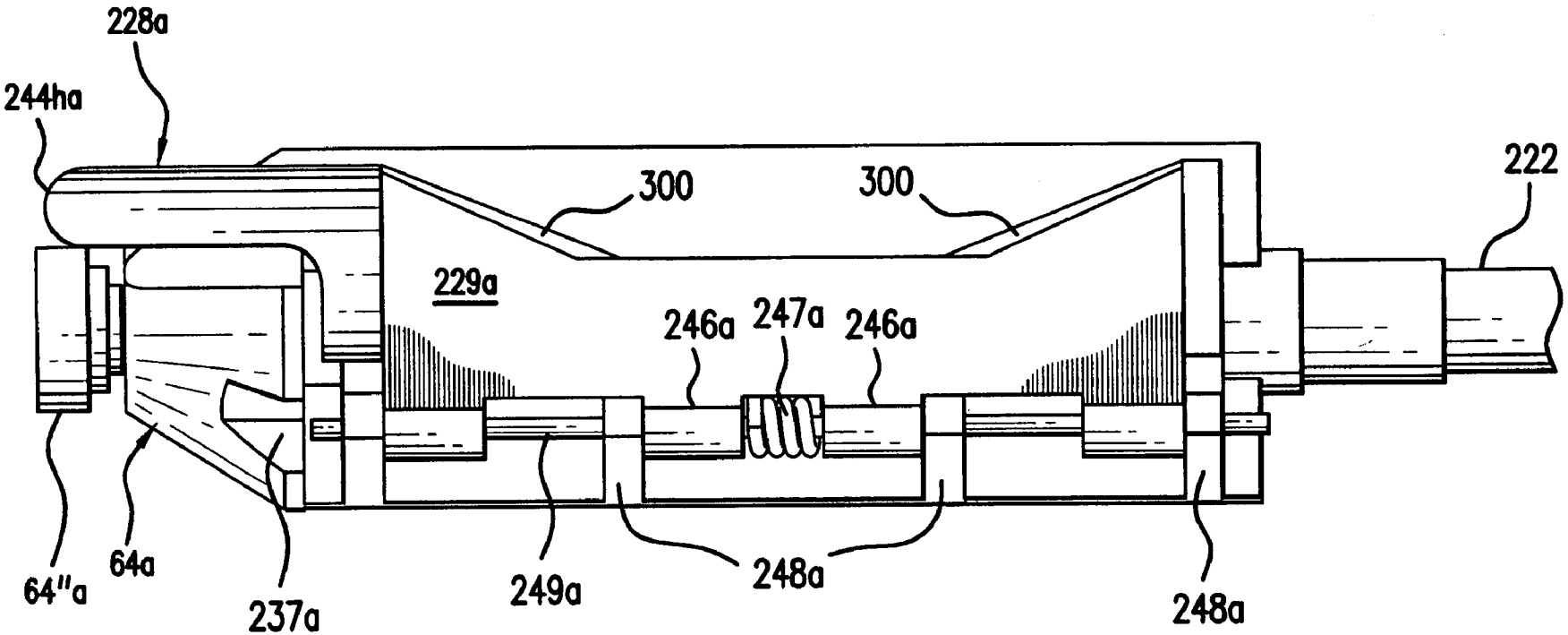
FIG. 31 is an elevational view of an alternative construction of a spindle and latch.

The embodiment of FIG. 31 is identical to the embodiment of FIGS. 1 through 30, except as shown to be different in FIG. 31 and as described herein. Identical structure is designated by the same reference characters with the addition of letter "a". In the embodiment of FIG. 31, instead of having opposed pairs of steps 238 through 243, there is a pair of continuous inclined shoulders or surfaces or edges 300 that extend upwardly and outwardly from the midpoint between them. The surfaces 300 also slope progressively in the same direction as the surfaces 238' through 244' so that irrespective of the width of the core 66 the surfaces 300 will be positioned against the inner surface 232 of the core 66 when the core 66 is centered or center-justified. The surfaces 300 have been considered to have an infinite number of small steps that form lines, preferably straight lines with a curved surface.

Figure 32:
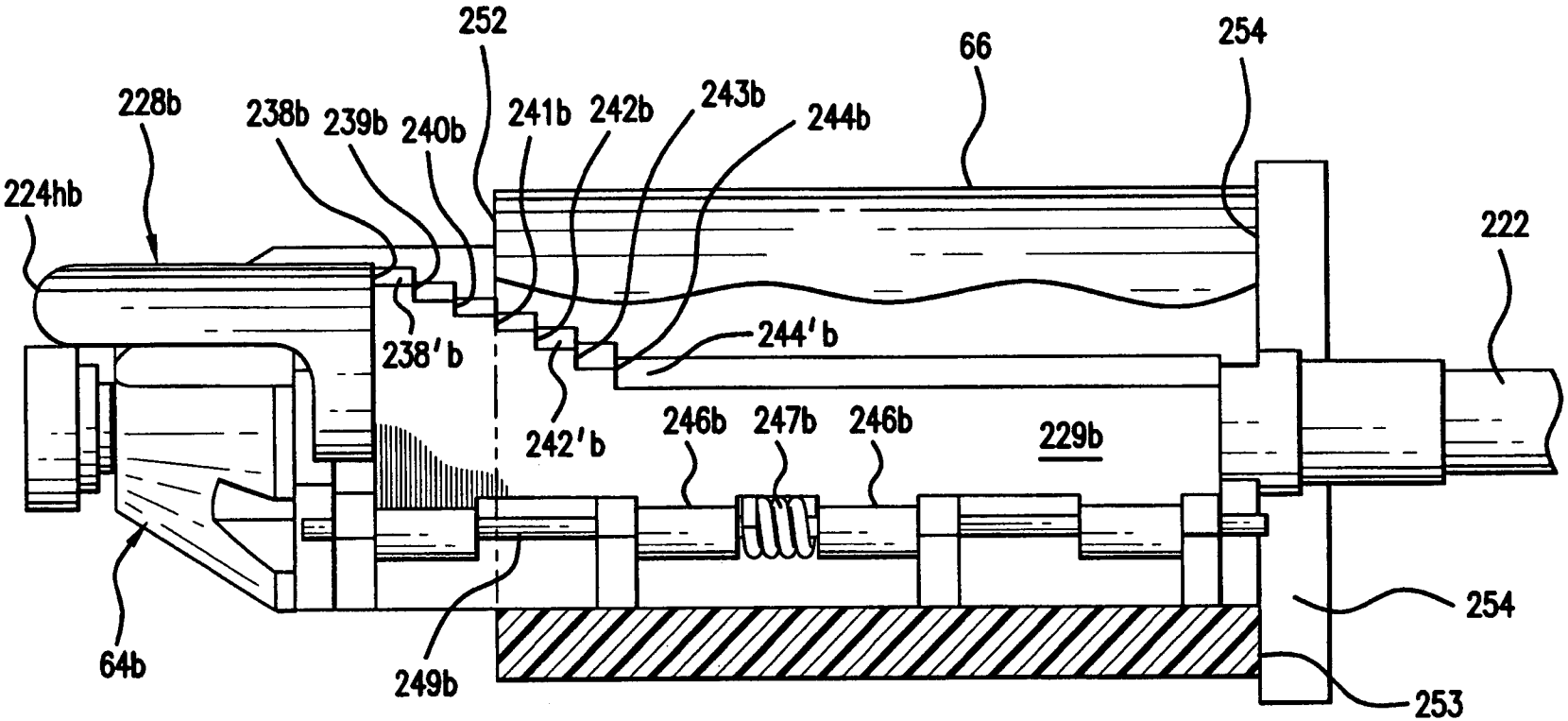
FIG. 32 is an elevational view partly in section of a spindle with a latch and a core which is edge-justified on the spindle.

FIG. 32 illustrates an alternative arrangement which can be used in a different printer in which edge-justification instead of center-justification is required. The embodiment of FIG. 32 is identical to the embodiment of FIGS. 1 through 30 except as shown to be different in FIG. 32 and as described herein. Identical structure is designated by the same reference characters with the addition of the letter "b". In the FIG. 32 embodiment, the spindle 64*b* has a flange 254 with a stop surface or shoulder 254' and the latch 228*b* differs from the latch 228 as noted below. In such an arrangement the core 66 would fit against the annular stop shoulder 254' and a latch or detent 228*b* having a latch member 229*b* would have shoulders 238*b* through 243*b* cooperating with only end face 252 of the core 66. One of the shoulders identified at 238*b* through 243*b* would pivot into position in opposition to the end portion face 252 and would be held in that position by a spring 247*b* when the core face 253 abuts the shoulder 254' at an edge-justified position as shown. In other respects the spindle 64*b* and the latch 228*b* are the same as the spindle 64 and the latch 228.

A method practiced in connection with the disclosure of FIG. 32 involves providing a spindle 64*b* and a set of connected stepped shoulders 238*b* through 243*b* movably mounted as a unit on the spindle 64*b*, wherein the spindle 64*b* is capable of mounting supply roll cores 66 of different widths having respective, webs of different width ink-ribbons I wound thereon, and moving the set of stepped shoulders 238*b* through 242*b* to bring the shoulder corresponding to the width of the core 66 in face-to-face relationship near the end 252 of the core 66 when the core 66 has been brought to an edge-justified stop position on the spindle 64*b*. FIG. 32 shows the shoulder 241*b* in face-to-face relationship to end 252 of the core 66. The core 66 can be removed by pivoting the latch member 229*b* against the force of the spring 247*b* to a position in which the core 66 can be slid off the spindle 64*b*.

Figure 33:
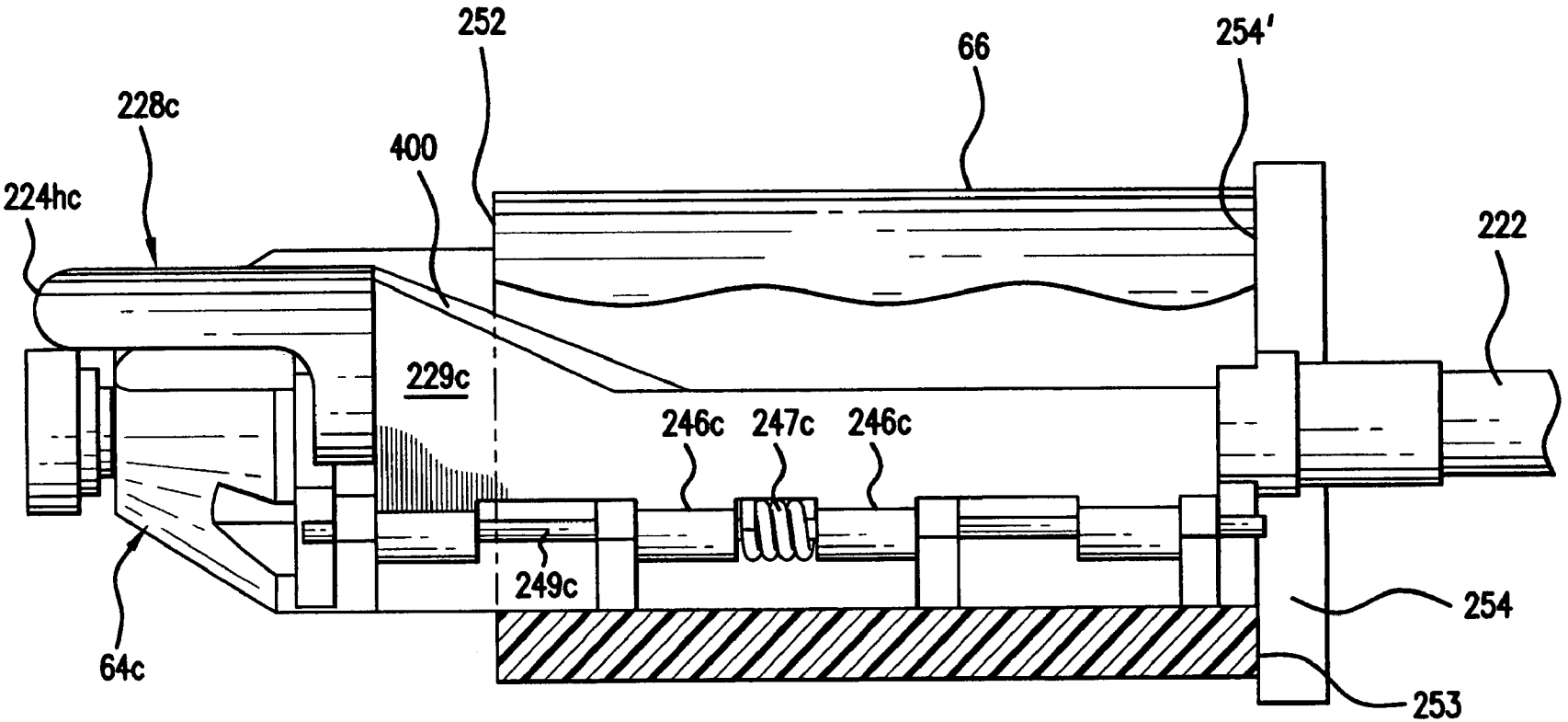
FIG. 33 is an elevational view partly in section of another alternative embodiment of a spindle and a latch with a core edge-justified on the spindle.

The embodiment of FIG. 33 is identical to the embodiment of FIG. 32, except as shown to be different in FIG. 33 and as described herein. Identical structure is designated by the same reference characters with the addition of the letter "c". In the embodiment of FIG. 33, instead of having steps 238*b* through 243*b*, there is a continuous inclined surface or shoulder or edge 400 that extends upwardly and outwardly from the flange 254. The surface 400 also has a continuously changing slope in the same direction as the surfaces 238'*b* through 244'*b*. When the core 66 is against the flange 254, the latch 228*c* will engage the inner edge of the face 252 when the spring 247*c* pivots the latch 228*c* to the latching or detenting position. To release the latch 228*c*, the handle 244*hc* is moved against the force of the spring 247*c*, and the core 66 can be slid off the spindle 64*c*.

Although the spindles 64, 64*a*, 64*b*, and 64*c* and the core 66 are illustrated in connection with an ink ribbon I, they can be used with other media such as printable and other types of wound webs, if desired.

Figure 34:
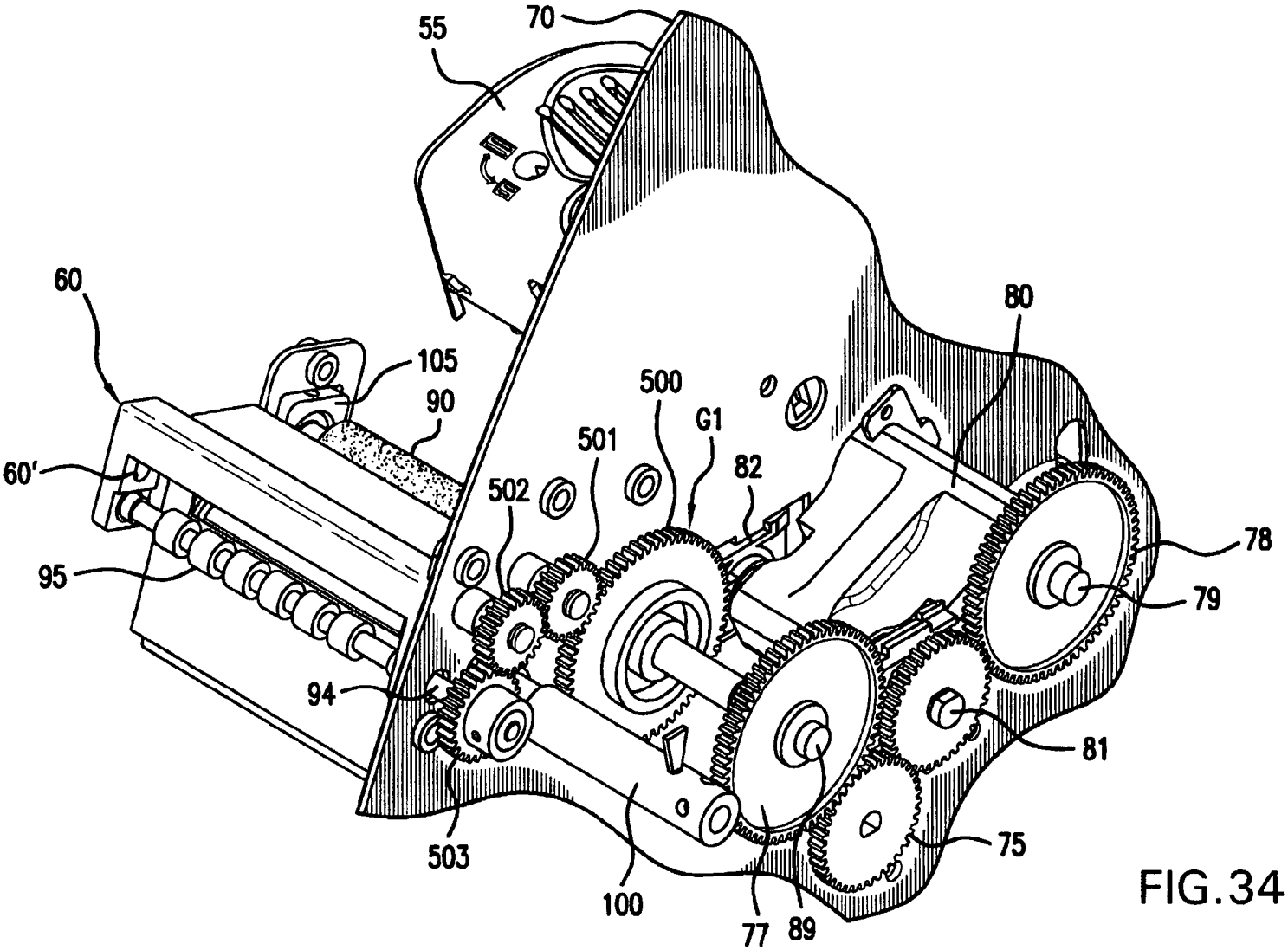
FIG. 34 is a most preferred embodiment showing the drive system including gearing for the stacker feed mechanism.

The most preferred embodiment of the drive for the stacker feed mechanism 60 is shown in FIG. 34. The FIG. 34 embodiment is identical to the embodiment of FIGS. 1 through 30 except that gearing G1 includes a gear 500 secured to the shaft 89, an idler gear 501 that meshes with the gear 500, another idler gear 502 that meshes with the gear 501, and a driven gear 503 meshing with the gear 502. The gear 503 is secured to the shaft 94 and rotates the roll 95 whenever the motor 73 is energized to operate gearing G and G1.

Other embodiments and modifications of the invention will suggest themselves to those skilled in the art, and all such of these as come within the spirit of this invention are included within its scope as best defined by the appended claims.

What is claimed is:

1. In combination:

a shaft having a threaded portion with right-hand threads and a threaded portion with left-hand threads, a hub to mount a web supply roll, the hub threadably receiving one of the threaded portions, a carrier threadably receiving the other threaded portion, at least one opening in the carrier, at least one clamp member movably mounted on the carrier between retracted and extended positions, wherein a supply roll is capable of being loaded onto the hub when the clamp member is in its retracted position and capable of being clamped at a side of the supply roll when the clamp member is in its extended position, and at least one rod received by the hub and extending into the opening in the carrier, the opening in the carrier being large enough to enable the carrier to rotate together with the shaft relative to the rod, the rod cooperating with the clamp member to move the clamp member from its retracted position to its extended position and to move the hub and the carrier with its clamp member toward each other to clamp the supply roll in a center-justified position upon rotation of the shaft in one direction and to move the hub and the clamp member away from each other and to move the clamp member from its extended position to its retracted position upon rotation of the shaft in the opposite direction.

2. The combination defined in claim 1, wherein the opening in the carrier comprises a slot.

3. The combination defined in claim 1, wherein the clamp member has an elongate slot through which the rod extends.

4. The combination defined in claim 1, wherein the other threaded portion and the carrier have right-hand threads.

5. The combination defined in claim 1, including an electric motor for rotating the shaft to tension the web.

6. The combination defined in claim 1, wherein the clamped web supply roll is center-justified relative to a print head.

7. The combination defined in claim 1, wherein the opening in the carrier comprises a slot, and the clamp member includes a slot, and the rod extends through the slots.

8. The combination defined in claim 1, wherein the clamp member is pivotally mounted on the carrier and has an elongate slot which receives the rod.

9. The combination defined in claim 1, wherein the threaded portions are long enough to enable the hub to hold web supply rolls of different widths.

10. The combination defined in claim 1, wherein the rod is secured to the hub.

11. The combination defined in claim 1, including a bell-shaped knob on the shaft in telescoping relationship to the carrier.

12. The combination defined in claim 1, including a bell-shaped knob on the shaft providing interior space, wherein the rod extends into the interior space.

13. The combination defined in claim 1, wherein there are:

a plurality of rods mounted on the hub, and a plurality of clamp members mounted on the carrier cooperable with the rods.

14. The combination defined in claim 1, wherein the hub includes a flange, wherein a web supply roll can be clamped between the flange and the clamp member.

15. The combination defined in claim 1, the shaft having opposite end portions, an electric motor for rotating one end portion, and a manually engageable knob capable of rotating the other end portion.

16. The combination defined in claim 1, wherein the movement of the clamp between retracted and extended position member takes place as soon as the shaft is manually rotated.

17. In combination:

a shaft having a threaded portion with right-hand threads and a threaded portion with left-hand threads, a hub to mount a web supply roll, the hub threadably receiving one of the threaded portions, a carrier threadably receiving the other threaded portion, at least one opening in the carrier, at least one clamp member movably mounted on the carrier between retracted and extended positions, wherein a supply roll is capable of being mounted on the hub when the clamp member is in its retracted position and capable of being clamped at a side of the supply roll when the clamp member is in its extended position, and at least one rod received by the hub and extending into the opening in the carrier, the opening in the carrier being large enough to enable the carrier to rotate together with the shaft relative to the rod, the rod cooperating with the clamp member to move the clamp member from its retracted position to its extended position and to move the hub and the carrier with the clamp member toward each other to clamp the supply roll in a center-justified position upon rotation of the shaft.

18. The combination defined in claim 17, wherein the opening in the carrier comprises a slot.

19. The combination defined in claim 17, wherein the clamp member has an elongate slot through which the rod extends.

20. The combination defined in claim 17, wherein the other threaded portion and the carrier have right-hand threads.

21. The combination defined in claim 17, including an electric motor for rotating the shaft to tension the web.

22. The combination defined in claim 17, wherein the clamped web supply roll is center-justified relative to a print head.

23. The combination defined in claim 17, wherein the opening in the carrier comprises a slot, and the clamp member includes a slot, and the rod extends through the slots.

24. The combination defined in claim 17, wherein the threaded portions are long enough to enable the hub to hold web supply rolls of different widths.

25. The combination defined in claim 17, wherein the rod is secured to the hub.

26. The combination defined in claim 17, including a bell-shaped knob on the shaft in telescoping relationship to the carrier.

27. The combination defined in claim 17, including a bell-shaped knob on the shaft providing interior space, wherein the rod extends into the interior space.

28. The combination defined in claim 17, wherein there are:

a plurality of rods mounted on the hub, and a plurality of clamp members mounted on the carrier cooperable with the rods.

29. The combination defined in claim 17, wherein the hub includes a flange, wherein a web supply roll can be clamped between the flange and the clamp member.

30. The combination defined in claim 17, the shaft having opposite end portions, an electric motor for rotating one end portion, and a manually engageable knob capable of rotating the other end portion.

31. The combination defined in claim 17, wherein movement of the clamp member between retracted and extended positions takes place as soon as the shaft is manually rotated.

32. In combination:

a manually rotatable shaft having a threaded portion with right-hand threads and a threaded portion with left-hand threads, a hub to mount a web supply roll, the hub threadably receiving one of the threaded portions, a carrier threadably receiving the other threaded portion, at least one opening in the carrier, at least one clamp member movably mounted on the carrier between retracted and extended positions, wherein a supply roll is capable of being loaded onto the hub when the at least one clamp member is in its retracted position and capable of being clamped at a side of the supply roll when the at least one clamp member is in its extended position, and at least one rod received by the hub and extending into the opening in the carrier to enable the carrier to rotate together with the shaft relative to the rod, and the rod cooperating with the clamp member to move the hub and the carrier with its clamp member away from each other and to move the clamp member from its extended position to its retracted position upon rotation of the shaft.

33. The combination defined in claim 32, wherein the opening in the carrier comprises a slot.

34. The combination defined in claim 32, wherein the clamp member has an elongate slot through which the rod extends.

35. The combination defined in claim 32, wherein the other threaded portion and the carrier have right-hand threads.

36. The combination defined in claim 32, including an electric motor for rotating the shaft to tension the web.

37. The combination defined in claim 32, wherein the clamped web supply roll is center-justified relative to a print head.

38. The combination defined in claim 32, wherein the opening in the carrier comprises a slot, and the clamp member includes a slot, and the rod extends through the slots.

39. The combination defined in claim 32, wherein the clamp member is pivotally mounted on the carrier, and the an elongate slot which receives the rod.

40. The combination defined in claim 32, wherein the threaded portions are long enough to enable the hub to hold web supply rolls of different widths.

41. The combination defined in claim 32, wherein the rod is secured to the hub.

42. The combination defined in claim 32, including a bell-shaped knob on the shaft in telescoping relationship to the carrier.

43. The combination defined in claim 32, including a bell-shaped knob on the shaft providing interior space, wherein the rod extends into the interior space.

44. The combination defined in claim 32, wherein there are:

a plurality of rods mounted on the hub, and a plurality of clamp members mounted on the carrier cooperable with the rods.

45. The combination defined in claim 32, wherein the hub includes a flange, wherein a web supply roll can be clamped between the flange and the clamp member.

46. The combination defined in claim 32, the shaft having opposite end portions, an electric motor to rotate one end portion, and a manually engageable knob capable of rotating the other end portion.

47. The combination defined in claim 32, wherein movement of the clamp member between retracted and extended positions takes place as soon as the shaft is manually rotated.

48. In combination:

a manually rotatable shaft having a threaded portion with right-hand threads and a threaded portion with left-hand threads, a hub to mount a web supply roll, the hub threadably receiving one of the threaded portions, a carrier threadably receiving the other threaded portion, a plurality of openings in the carrier, a plurality of clamp members movably mounted on the carrier between retracted and extended positions, wherein a supply roll is capable of being loaded onto the hub when the clamp members are in their retracted positions and capable of being clamped at a side of the supply roll when the clamp members are in their extended positions, and a plurality of rods received by the hub and extending into the openings in the carrier to enable the carrier to rotate together with the shaft relative to the rods, the rods cooperating with the clamp members to move the clamp members from their retracted positions to their extended positions and to move the hub and the carrier with the clamp members toward each other to clamp the supply roll in a center-justified position upon rotation of the shaft in one direction and to move the hub and the clamp members away from each other and to move the clamp members from their extended positions to their retracted positions upon rotation of the shaft in the opposite direction.

49. In combination:

a manually rotatable shaft having a threaded portion with right-hand threads and a threaded portion with left-hand threads, a hub to mount a web supply roll, the hub threadably receiving one of the threaded portions, a carrier threadably receiving the other threaded portion, a plurality of openings in the carrier, a plurality of clamp members movably mounted on the carrier between retracted and extended positions, wherein a supply roll is capable of being loaded onto the hub when the clamp members are in their retracted positions and capable of being clamped at a side of the supply roll when the clamp members are in their extended positions, and a plurality of rods received by the hub and extending into the openings in the carrier to enable the carrier to rotate together with the shaft relative to the rods, the rods cooperating with the clamp members to move the clamp members from their retracted positions to their extended positions and to move the hub and the carrier with the clamp members toward each other to clamp the supply roll in a center-justified position upon rotation of the shaft in one direction.

50. In combination:

a manually rotatable shaft having a threaded portion with right-hand threads and a threaded portion with left-hand threads, a hub to mount a web supply roll, the hub threadably receiving one of the threaded portions, a carrier threadably receiving the other threaded portion, a plurality of openings in the carrier, a plurality of clamp members movably mounted on the carrier between retracted and extended positions, wherein a supply roll is capable of being loaded onto the hub when the clamp members are in their retracted positions and capable of being clamped at a side of the supply roll when the clamp members are in their extended positions, and a plurality of rods received by the hub and extending into the openings in the carrier to enable the carrier to rotate together with the shaft relative to the rods, the rods cooperating with the clamp members to move the hub and the carrier with the clamp members away from each other and to move the clamp members from their extended positions to their retracted positions upon rotation of the shaft.

51. In combination:

an axially extending manually rotatable shaft having a threaded portion with right-hand threads and a threaded portion with left-hand threads, a hub to mount a supply roll, the hub threadably receiving one of the threaded portions, a carrier axially spaced from the hub and threadably receiving the other threaded portion, at least one clamp member movably mounted on the carrier, the clamp member being movable between extended and retracted positions, the at least one clamp member having a slot, and at least one control member received by the hub and extending through the slot, the carrier being rotatable relative to the control member so that manual rotation of the shaft causes the control member to move the clamp member from its retracted position to its extended position and causes the hub and the carrier with the clamp member to move toward each other so that the at least one clamp member clamps the side of the supply roll in a center-justified position.

52. In combination:

an axially extending manually rotatable shaft having a threaded portion with right-hand threads and a threaded portion with left-hand threads, a hub to mount a supply roll, the hub threadably receiving one of the threaded portions, a carrier spaced axially from the hub and threadably receiving the other threaded portion, at least one clamp member movably mounted on the carrier, the clamp member being movable between extended and retracted positions, the at least one clamp member having a slot, and at least one control member received by the hub and extending through the slot, the carrier being rotatable relative to the control member so that manual rotation of the shaft causes the hub and the carrier with the clamp member to move away from each other and causes the control member to move the clamp member from its extended position to its retracted position.

53. In combination:

an axially extending manually rotatable shaft having a threaded portion with right-hand threads and a threaded portion with left-hand threads, a hub to mount a web supply roll, the hub threadably receiving one of the threaded portions, a carrier axially spaced from the hub and threadably receiving the other threaded portion, at least one clamp member movably mounted on the carrier, the clamp member being movable between extended and retracted positions, the clamp member having a slot, and at least one control member received by the hub and extending through the slot, the carrier being rotatable relative to the control member, the control member cooperating with the clamp member to move the clamp member from its retracted position to its extended position and to move the hub and the carrier with the clamp member toward each other to clamp the supply roll in a center-justified position upon rotation of the shaft in one direction to move the hub and the carrier with the clamp member away from either other and to move the clamp member from its extended position to its retracted position upon rotation of the shaft in the opposite direction.

* * * * *